US010534289B2

(12) United States Patent
Yang et al.

(10) Patent No.: US 10,534,289 B2
(45) Date of Patent: Jan. 14, 2020

(54) TONER CONTAINER AND IMAGE FORMING DEVICE HAVING A SWITCHING MEMBER IN THE STRUCTURE OF A SHELL

(71) Applicant: Konica Minolta, Inc., Tokyo (JP)

(72) Inventors: Shuan Yang, Kariya (JP); Naoki Nonoyama, Toyokawa (JP); Shigeru Sawano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/159,019

(22) Filed: Oct. 12, 2018

(65) Prior Publication Data

US 2019/0121257 A1 Apr. 25, 2019

(30) Foreign Application Priority Data

Oct. 19, 2017 (JP) ..... 2017-202723

(51) Int. Cl.
*G03G 15/08* (2006.01)
*G03G 21/16* (2006.01)
*G03G 21/18* (2006.01)

(52) U.S. Cl.
CPC ..... *G03G 15/0875* (2013.01); *G03G 15/0886* (2013.01); *G03G 21/1619* (2013.01); *G03G 21/1814* (2013.01); *G03G 21/1832* (2013.01); *G03G 2215/068* (2013.01); *G03G 2215/0692* (2013.01); *G03G 2221/1869* (2013.01)

(58) Field of Classification Search
CPC ..... G03G 15/0875
USPC ..... 399/262
See application file for complete search history.

(56) References Cited

U.S. PATENT DOCUMENTS 6,721,525 B2 * 4/2004 Wang ..... G03G 15/0896 399/258
2014/0029984 A1 * 1/2014 Fujii ..... G03G 15/0865 399/258

FOREIGN PATENT DOCUMENTS

JP H11231630 A 8/1999
JP 2015225306 A 12/2015

* cited by examiner

*Primary Examiner* — Walter L Lindsay, Jr.
*Assistant Examiner* — Philipmarcus T Fadul
(74) *Attorney, Agent, or Firm* — Lucas & Mercanti, LLP

(57) ABSTRACT

A toner container attachable to and detachable from a main body of an image forming device and including: a first chamber containing toner; a second chamber adjacent to the first chamber through a partition wall and downstream of the first chamber in a toner supply direction; and a switching member in the second chamber that is movable or rotatable and has a shell structure. The partition wall has a first aperture. A bottom wall of the second chamber opposing the partition wall has a second aperture and sits on the main body. The shell has third and fourth apertures. The fourth aperture coincides with the second aperture when the third aperture coincides with the first aperture, and the first aperture is closed by the shell when the third aperture faces an inner wall surface of the second chamber.

16 Claims, 11 Drawing Sheets

TONER CONTAINER AND IMAGE FORMING DEVICE HAVING A SWITCHING MEMBER IN THE STRUCTURE OF A SHELL

This application claims priority to Japanese Patent Application No. 2017-202723 filed Oct. 19, 2017, the contents of which are hereby incorporated herein by reference in its entirety.

BACKGROUND

Technical Field

The present disclosure relates to a toner container that is attachable to and detachable from a main body of an image forming device and that supplies toner.

Description of the Related Art

In a typical image forming device such as a copier, a facsimile, or a printer, toner in a toner container is supplied to a developing unit of the image forming device.

A known mechanism for improving operability when replacing the toner container after the toner contained therein is used up is as follows: a toner discharge outlet for supplying toner to the developing unit is opened or closed through causing a switching member such as a shutter member to slide in a single operation in accordance with a user operation of attaching the toner container to a main body of the image forming device or detaching the toner container from the main body.

In a structure in which the switching member is located outside the toner container, when the toner container is detached from the image forming device by the user during replacement of the toner container, toner may adhere around the toner discharge outlet and/or around a toner supply inlet of the developing unit, and consequently to the switching member. The toner container has a structure such that the user could touch the switching member, which is located outside the toner container, and therefore there is a risk that toner could leak outside when the user opens the switching member.

In order to overcome this problem, an inner opening-closing mechanism in which the switching member is located inside the toner container has been proposed.

In a toner container in which an opening-closing mechanism is located inside the toner container, for example, when a toner container 1 is not attached to a main body of an image forming device, a switching member 2 located inside the toner container 1 is biased in a direction toward the outside of the toner container 1 by a biasing member 5 and closes a discharge outlet 4 of the toner container 1 as illustrated in FIG. 14A and FIG. 14B. When the toner container 1 is attached to the main body of the image forming device, a switching control rod 7 located in the image forming device presses the switching member 2 such that the switching member 2 is moved in a direction toward an inside of the toner container 1. Due to this, an aperture 3 of the switching member 2 is moved to the position of the discharge outlet 4 of the toner container 1 and the discharge outlet 4 of the toner container 1 opens. Toner inside the toner container 1 thus is supplied through the aperture 3 and the discharge outlet 4 to a developing unit.

As described above, due to the switching member located inside the toner container, even when toner adheres to the switching member, the user is prevented from touching the switching member and toner would not leak outside.

However, in the toner container 1 in FIG. 14A and FIG. 14B, when the switching member 2 is moved in a direction in which the discharge outlet 4 of the toner container 1 is opened due to the toner container 1 being attached to the main body of the image forming device, a pressure in a closed space inside the toner container 1 increases due to movement of the switching member 2 toward the inside until the discharge outlet 4 opens. Due to this, at the moment when the discharge outlet 4 opens, the space inside the toner container 1 is depressurized from the discharge outlet 4 because of a difference between the pressure in the closed space inside the toner container 1 and the external air pressure, and toner that is held inside the toner container 1 blows out from the discharge outlet 4 and adheres to an area around the discharge outlet 4 outside the toner container 1.

In order to solve the problem described above, JPH11-231630 proposes a technology for eliminating the difference between the pressure in the closed space inside the toner container and the external air pressure with use of a depressurizing filter through which air passes but toner does not pass.

SUMMARY

However, in the technology of JPH11-231630, use of the air-permeable filter leads to complication of the mechanism and increase of costs. Further, the difference between the pressure in the closed space inside the toner container and the external air pressure depends on air permeability of the filter, and therefore the difference between the pressure in the closed space inside the toner container and the external air pressure cannot be completely eliminated depending on the characteristics of the filter.

The present disclosure aims to provide a toner container and an image forming device that help to overcome the above-described problems and to prevent toner held inside the toner container from blowing out from the discharge outlet of the toner container through eliminating the difference between the pressure in the closed space inside the toner container and the external air pressure.

To achieve at least one of the above-mentioned objects, a toner container reflecting at least one aspect of the present disclosure is a toner container that is attachable to and detachable from a main body of an image forming device, the toner container including: a first chamber that contains toner; a second chamber that is adjacent to the first chamber through a partition wall and that is located downstream of the first chamber in a direction along which toner is supplied; and a switching member that is accommodated in the second chamber, that is movable or rotatable in the second chamber, and that has a structure of a shell. In the toner container, the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member. Here, the inner wall surface of the second chamber may be an inner wall surface of the bottom wall of the second chamber.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the disclosure. In the drawings:

FIG. 11A is an external perspective view of the switching member 203 immediately before a switching control rod 231Y abuts a cam surface 222, FIG. 11B is an external perspective view of the switching member 203 during the rotation, and FIG. 11C is an external perspective view of the switching member 203 when the rotation is completed;

DETAILED DESCRIPTION

Hereinafter, one or more embodiments of the present disclosure will be described with reference to the drawings. However, the scope of the disclosure is not limited to the disclosed embodiments.

1 Embodiment

The following describes an image forming device 10 that is an embodiment pertaining to the present disclosure, with reference to the drawings.

1.1 Structure of Image Forming Device 10

Figure 1:
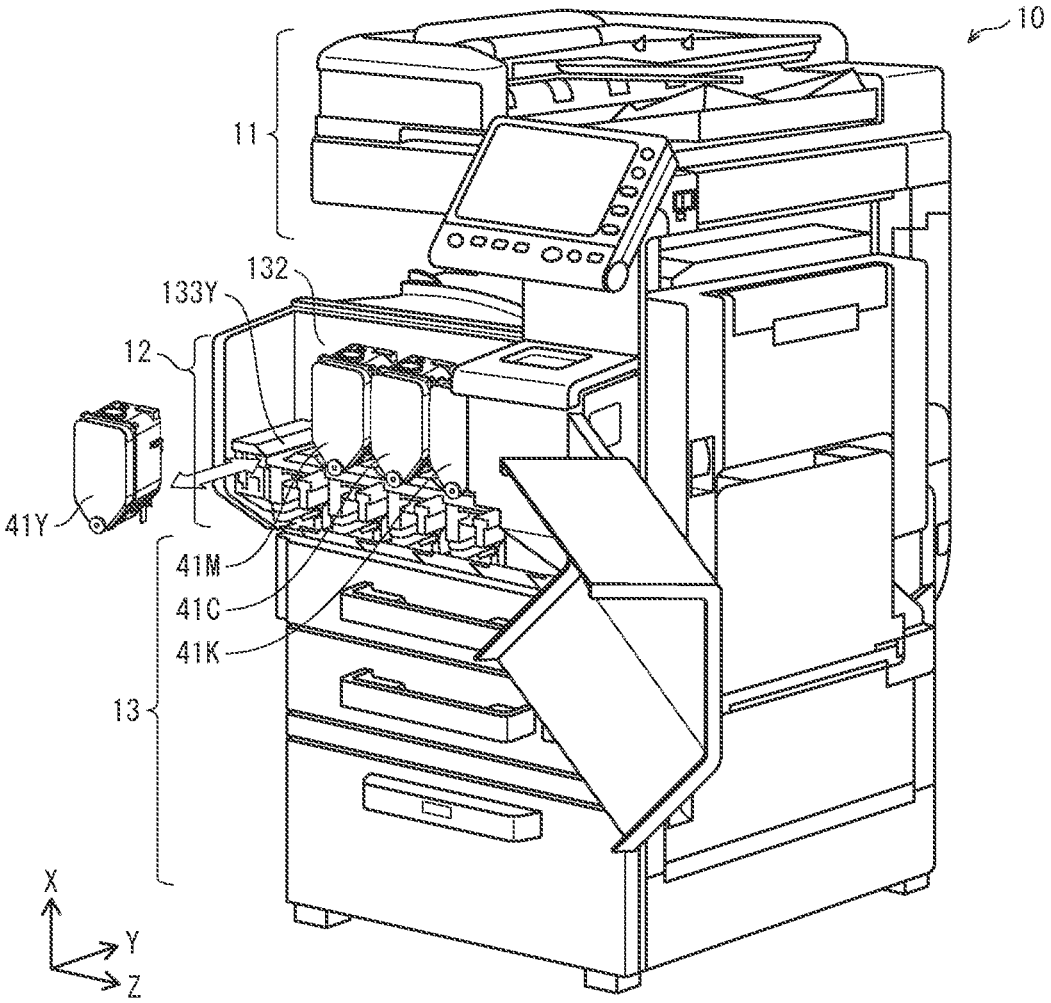
FIG. 1 is an external perspective view of an image forming device 10 of an embodiment.

FIG. 1 is an external perspective view of an image forming device 10.

As illustrated in FIG. 1, the image forming device 10 is, for example, a tandem-type color multi-function peripheral (MFP) having functions of a scanner, a printer, and a copier.

The image forming device 10 includes an image reading unit 11 reading an image from a document, a printing unit 12 forming a toner image on a recording sheet, and a sheet feeding unit 13 storing and feeding a recording sheet.

Here, a main scanning direction of the image forming device 10 is referred to as a Y-axis direction, and a sub scanning direction of the image forming device 10 is referred to as a Z-axis direction. A direction orthogonal to both the Y-axis direction and the Z-axis direction is referred to as an X-axis direction.

The printing unit 12 has container holders 133Y, 133M, 133C, and 133K (some of which are not accompanied with reference signs in FIG. 1) at a front of a housing accommodating the printing unit 12. The container holders 133Y, 133M, 133C, and 133K respectively hold toner containers 41Y, 41M, 41C, and 41K in an attachable and detachable manner. The toner containers 41Y, 41M, 41C, and 41K respectively sit on the container holders 133Y, 133M, 133C, and 133K. The toner containers 41Y, 41M, 41C, and 41K respectively contain toner of colors yellow (Y), magenta (M), cyan (C), and black (K).

Regarding the image forming device 10, the part that remains after the toner containers 41Y, 41M, 41C, and 41K are removed is referred to as a main body of the image forming device 10. The toner containers 41Y, 41M, 41C, and 41K are attachable to and detachable from the main body of the image forming device 10.

The toner container 41Y is attached to the container holder 133Y from the front toward a back of the housing accommodating the printing unit 12 (i.e. along the Y-axis direction). The toner container 41M, the toner container 41C, and the toner container 41K are respectively attached to the container holder 133M, the container holder 133C, and the container holder 133K in a manner similar to the toner container 41Y.

In the container holders 133Y, 133M, 133C, and 133K, switching control rods 131Y, 131M, 131C, and 131K (FIG. 7; some of which are not illustrated) are arranged on a side wall 132 that is in parallel with an X-Z plane (in a vertical direction). The switching control rods 131Y, 131M, 131C, and 131K each protrude along the main scanning direction (Y-axis direction) from inside the printing unit 12 to the front of the printing unit 12 (a direction opposite a direction along which the toner containers 41Y, 41M, 41C, and 41K are attached). The switching control rod 131Y is configured to pass through an aperture 111 (described later) into a second container portion 102 of the toner container 41Y. The switching control rod 131M, the switching control rod 131C, and the switching control rod 131K each have a structure similar to the switching control rod 131Y.

Figure 2:
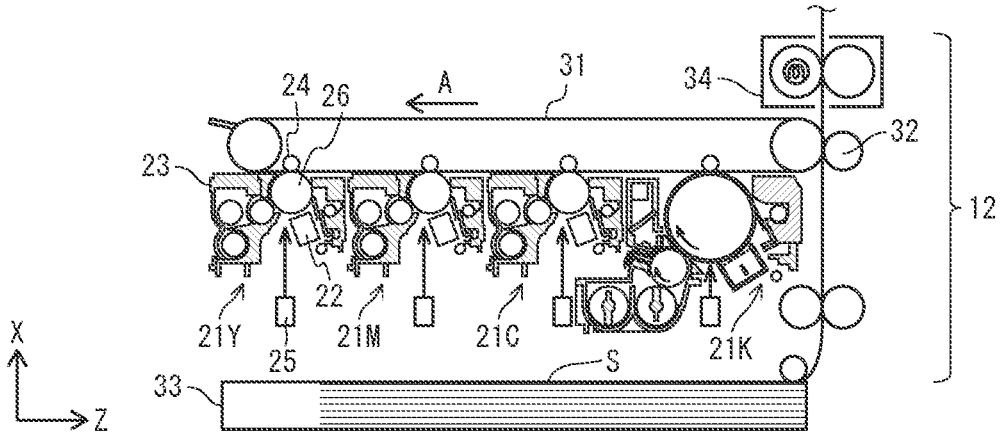
FIG. 2 is a schematic cross-sectional view mainly illustrating a structure of a printing unit 12.

FIG. 2 is a schematic cross-sectional view mainly illustrating the structure of the printing unit 12.

The printing unit 12 includes image forming units 21Y, 21M, 21C, and 21K that respectively form toner images of the colors Y, M, C, and K under control of a control unit (not illustrated) of the image forming device 10. The image forming units 21Y, 21M, 21C, and 21K respectively correspond to the toner containers 41Y, 41M, 41C, and 41K in FIG. 1, and are respectively supplied with toner from the toner containers 41Y, 41M, 41C, and 41K.

In the image forming unit 21Y, a charging unit 22 uniformly charges a circumferential surface of a photoreceptor drum 26. An optical writing unit 25 includes light-emitting elements that are linearly arrayed in the main scanning direction and causes the light-emitting elements to emit light in accordance with a digital signal generated by the control unit. Due to this, optical writing onto the circumferential surface of the photoreceptor drum 26 is performed, and an electrostatic latent image is formed.

The toner container 41Y supplies toner of the color Y to a developing unit 23. The developing unit 23 supplies toner to the circumferential surface of the photoreceptor drum 26 and develops the electrostatic latent image to form a toner image. A primary transfer roller 24 electrostatically transfers the toner image from the photoreceptor drum 26 to an intermediate transfer belt 31 (primary transfer).

Similarly, the image forming units 21M, 21C, and 21K are respectively supplied with toner from the toner containers 41M, 41C, and 41K and form toner images of the colors M, C, and K. Then, the toner images formed by the image forming units 21M, 21C, and 21K are transferred onto the intermediate transfer belt 31 (primary transfer) such that the toner images overlap with each other to form a color toner image. The color toner image formed through the primary transfer is conveyed to the secondary transfer roller 32 by the intermediate transfer belt 31, which rotates in a direction expressed by arrow A. In accordance with this, a recording sheet S is fed from a sheet feed cassette 33 of the sheet feeding unit 13 and is conveyed to the secondary transfer roller 32.

The secondary transfer roller 32 electrostatically transfers the toner image on the intermediate transfer belt 31 onto the recording sheet S (secondary transfer). The recording sheet S onto which the toner image is transferred is conveyed to a fixing unit 34, and the toner image is thermally fixed onto the recording sheet S. Then, the recording sheet S is ejected outside the image forming device 10.

1.2 Toner Container 41Y

Figure 3:
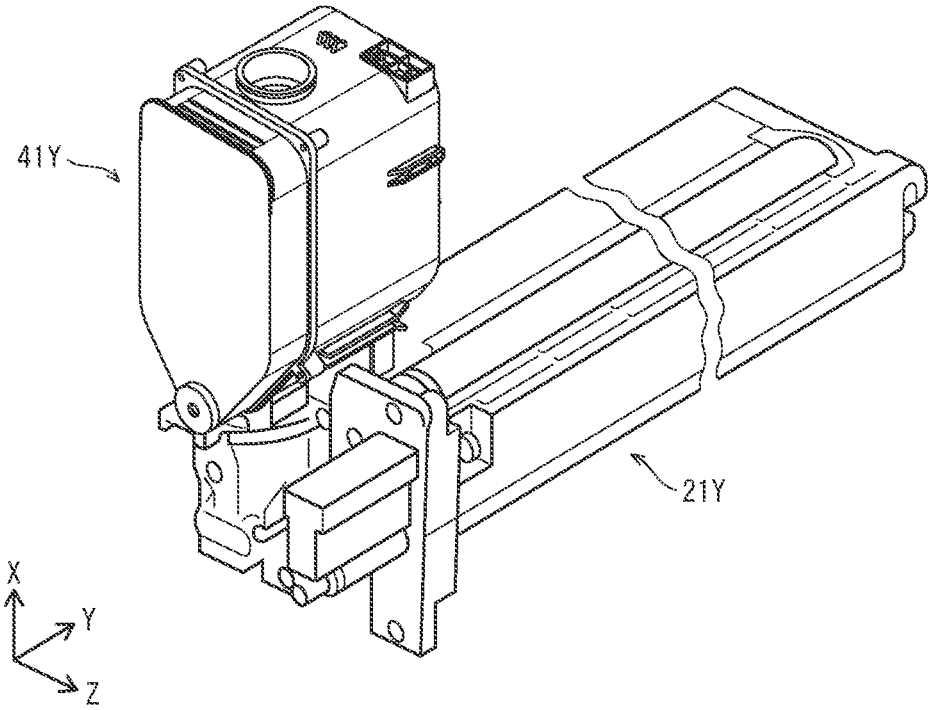
FIG. 3 is an external perspective view of an image forming unit 21Y and a toner container 41Y in a state in which the toner container 41Y is attached to the printing unit 12.

FIG. 3 is an external view of the image forming unit 21Y and the toner container 41Y in a state in which the toner container 41Y is attached to the printing unit 12. When the toner container 41Y is attached to the printing unit 12, as illustrated in FIG. 3, the toner container 41Y is located along a main scanning direction of the image forming unit 21Y above an end of the printing unit 12 close to the front of the housing of the printing unit 12. The toner container 41M, the toner container 41C, and the toner container 41K each have a structure similar to the toner container 41Y.

Figure 4:
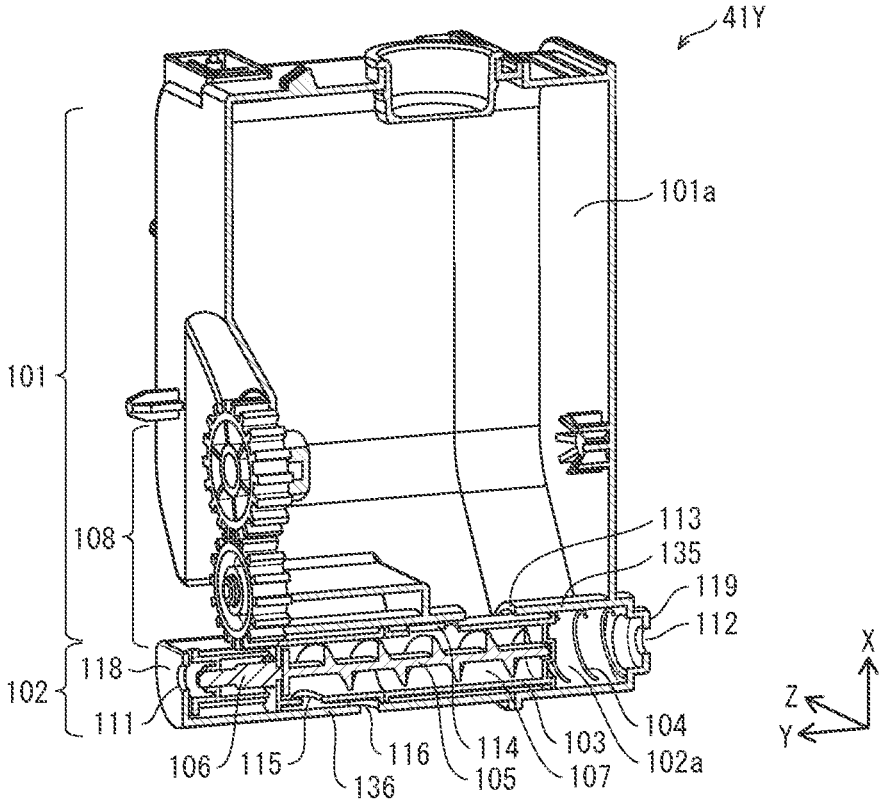
FIG. 4 is a perspective view of an inside of the toner container 41Y in a state in which the toner container 41Y is not attached to the printing unit 12.

The following describes the structure of the toner container 41Y, with reference to FIG. 4. FIG. 4 is a perspective view of an inside of the toner container 41Y. The toner container 41Y is covered by an exterior member that is not illustrated in FIG. 4. The toner containers 41M, 41C, and 41K have structures similar to the structure of the toner container 41Y, and therefore are not described here.

As described below, in order to improve operability when replacing the toner container 41Y, a supply path 145 (FIG. 6) of the toner container 41Y for supplying toner is opened through movement (sliding) of a switching member 103 in a single operation in accordance with an operation of attachment of the toner container 41Y to the printing unit 12.

That is, the toner container 41Y is switched between a first state and a second state in accordance with an operation of attachment and detachment of the toner container 41Y to and from the printing unit 12. Specifically, the first state is a state in which the switching member 103 is closing the supply path to block supply of toner from the toner container 41Y when the toner container 41Y is not attached to the printing unit 12 and after attachment of the toner container 41Y to the printing unit 12 is started until the attachment of the toner container 41Y to the main body of the image forming device 10 is completed. The second state is a state in which the switching member 103 opens the supply path to supply toner to a main body of the printing unit 12 when attachment of the toner container 41Y to the printing unit 12 is completed.

As illustrated in FIG. 4, the toner container 41Y includes a first container portion 101 and a second container portion 102 connected below the first container portion 101.

(First Container Portion 101)

The first container portion 101 has a shape such that an upper portion of the first container portion 101 is substantially box-shaped and a bottom portion of the first container portion 101 has a semi-cylindrical shape with a cross-section that is convex downwards. An inside of the first container portion 101 is a hollow space that is a first chamber 101*a* for storing toner. The first chamber 101*a* is adjacent to a second chamber 102*a* (described later) of the second container portion 102 at a bottom portion of the first chamber 101*a* through a partition wall 135. The partition wall 135 has a discharge outlet (first aperture) 113 and the first chamber 101*a* is connected to the second chamber 102*a* through the discharge outlet 113.

At a lower portion of the inside of the first container portion 101, a stirring blade that is not illustrated is disposed. In a state in which the toner container 41Y is attached to the printing unit 12, the stirring blade receives a rotary driving force from the printing unit 12 through a wheel mechanism 108 located at a side surface of the toner container 41Y. The transmitted rotary driving force causes the stirring blade to rotate, and the rotation of the stirring blade stirs toner in the first container portion 101. This helps to prevent toner from solidifying.

(Second Container Portion 102)

Figure 5:
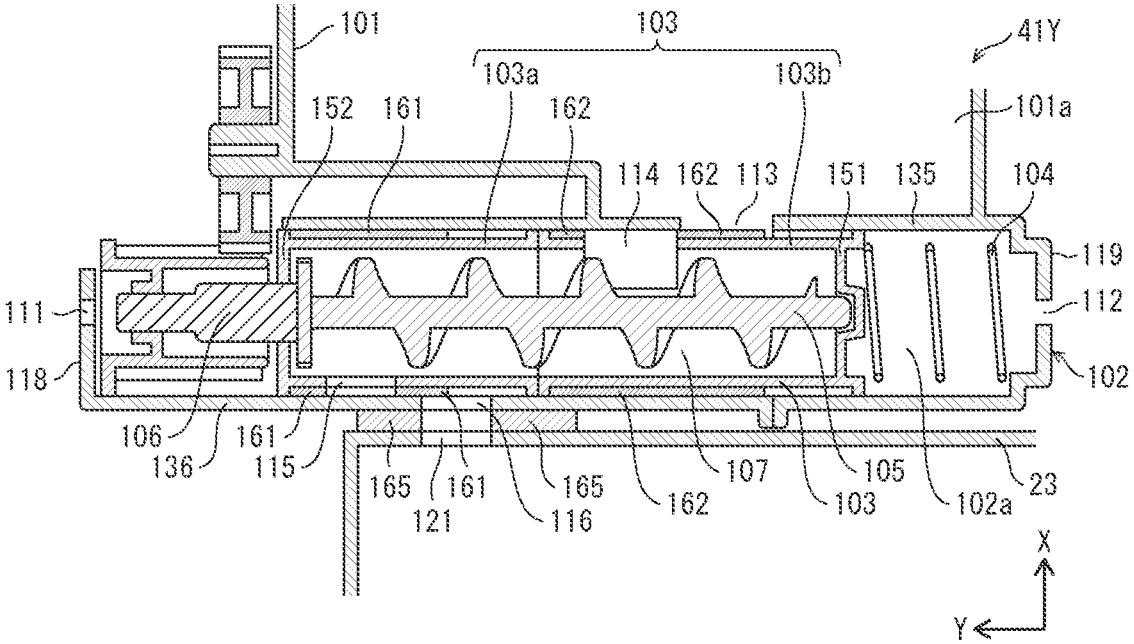
FIG. 5 is a cross-sectional view of a second container portion 102 of the toner container 41Y in a state in which the toner container 41Y is not attached to the printing unit 12.

FIG. 5 is a cross-sectional view of the second container portion 102 of the toner container 41Y in a state in which the toner container 41Y is not attached to the printing unit 12.

The second container portion 102 is located downstream of the first container portion 101 in a direction along which toner is supplied. In FIG. 5, the second container portion 102 has a shape of a cylinder elongated in the same direction as a longitudinal direction of the bottom portion of the first container portion 101, and has an end surface 118 and an end surface 119 at the ends of the cylinder. An inside of the second container portion 102 is a hollow space that is a second chamber 102*a*. The second chamber 102*a* is located downstream of the first chamber 101*a* in the direction along which toner is supplied. The end surface 118 has an aperture (fifth aperture; vent hole) 111 and the end surface 119 has an aperture (vent hole) 112. The hollow space inside the second container portion 102 is connected through the aperture 111 and the aperture 112 to the outside. The aperture 111 and the aperture 112 each function as a vent hole that ventilates to the outside. Note that the aperture 111 functions both as an insertion hole through which the switching control rod 131Y is inserted and a vent hole for ventilating to the outside.

Inside the second container portion 102, the switching member 103 is accommodated (inserted) such that the switching member 103 is movable in a longitudinal direction of the switching member 103. At an end surface 119-side inside the second container portion 102, a biasing member 104 having a shape of, for example, a coil is disposed. One end of the coil of the biasing member 104 is engaged with the end surface 119, and the other end of the coil of the biasing member 104 is engaged with an end surface 151 opposing the end surface 119 of the switching member 103. Inside the second container portion 102, the biasing member 104 biases the switching member 103 toward the end surface 118, which is opposite the end surface 119.

Figure 6:
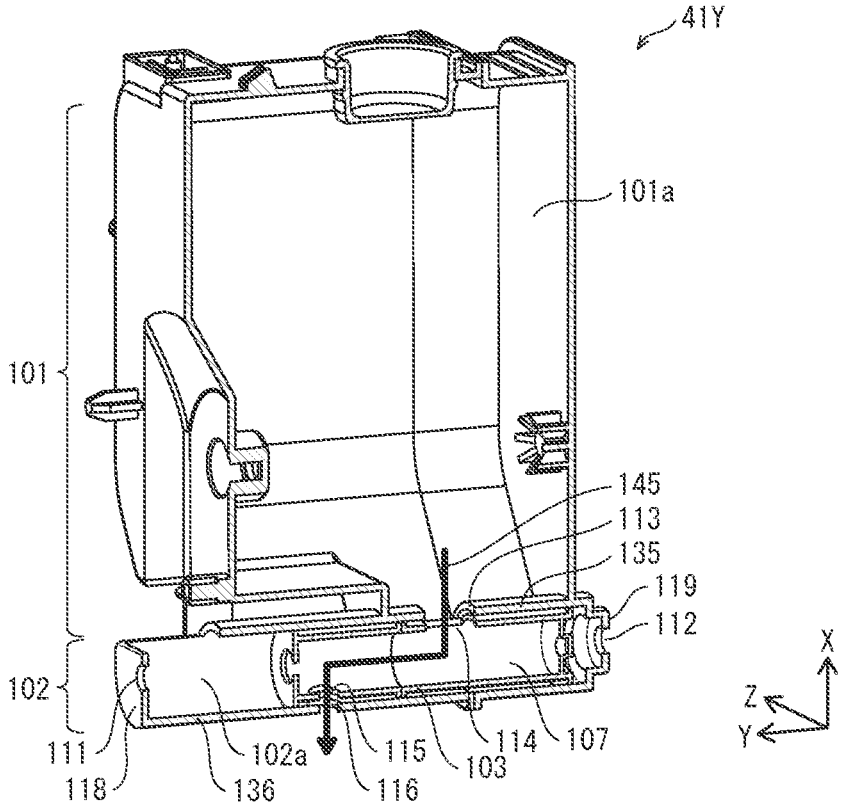
FIG. 6 is a perspective view of the inside of the toner container 41Y in a state in which the toner container 41Y is attached to the printing unit 12, in which a conveyance member 105 is not illustrated.
Figure 7:
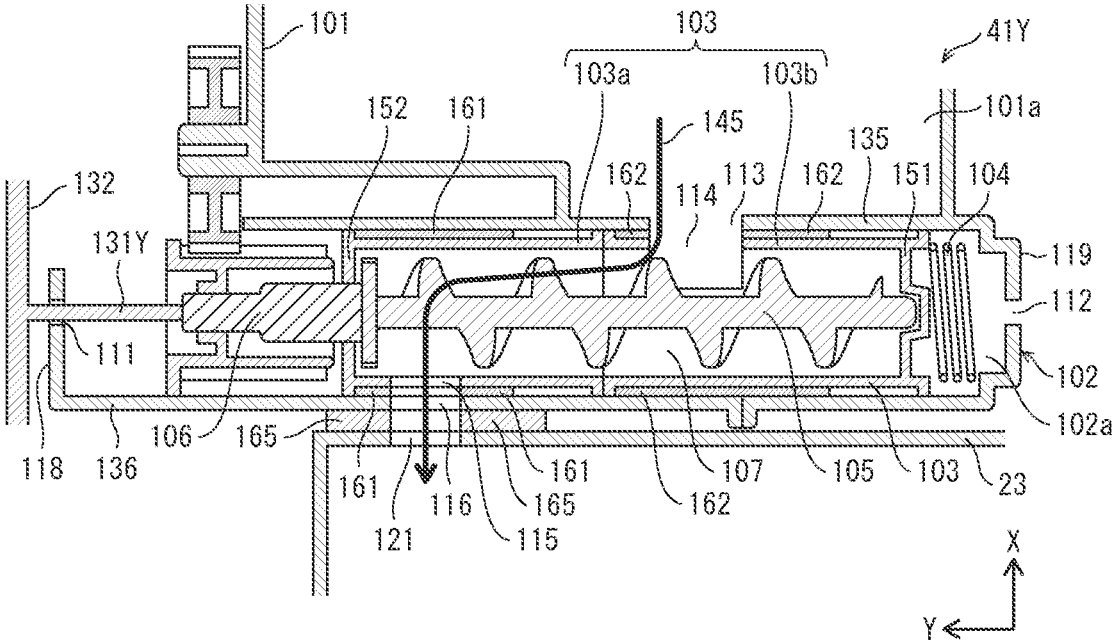
FIG. 7 is a cross-sectional view of the second container portion 102 of the toner container 41Y in a state in which the toner container 41Y is attached to the printing unit 12.

Further, the inside of the second container portion 102 is connected to the inside of the first container portion 101 by the discharge outlet 113, which is provided at the bottom portion of the first container portion 101. Further, a bottom wall (bottom wall of the toner container 41Y) 136 at a lower portion of the second container portion 102 has a discharge outlet (second aperture) 116. In FIG. 6 and FIG. 7, in a state in which the toner container 41Y is attached to the printing unit 12, the inside of the second container portion 102 is connected through the discharge outlet 116 and a supply inlet 121 of the developing unit 23 to the developing unit 23. Note that FIG. 6 is a perspective view of the inside of the toner container 41Y in a state in which the toner container 41Y is attached to the printing unit 12, and FIG. 7 is a cross-sectional view of an area around the second container portion 102 of the toner container 41Y in a state in which the toner container 41Y is attached to the printing unit 12.

(Switching Member 103)

As illustrated in FIG. 4 and FIG. 5, the switching member 103 has a structure of a shell having a shape of a cylinder that is elongated in the same direction as a longitudinal direction of the second container portion 102 and that has the end surface 151 and an end surface 152 at the ends of the cylinder of the switching member 103. An inside of the switching member 103 is a hollow space having a defined capacity that is a chamber 107 containing toner. The shell of the switching member 103 is a hollow container having a defined capacity. An aperture (third aperture) 114 is provided at an upper portion of a side surface of the cylinder of the switching member 103, and an aperture (fourth aperture) 115 is provided at a lower portion of the side surface of the cylinder of the switching member 103.

In the first state described later, the space in the second container portion 102 excluding the space occupied by the switching member 103 (space in which the biasing member 104 is located in the second container portion 102) is blocked from the space in the first container portion 101 by the switching member 103.

Due to manufacturing reasons, the switching member 103 is, as illustrated in FIG. 5, formed through connecting a cylindrical member 103*a* and a cylindrical member 103*b*. The cylindrical member 103*a* only has the end surface 152, and the cylindrical member 103*b* only has the end surface 151. When forming a cylindrical member having two end surfaces with use of metal molds, forming two cylindrical members each having one end surface and then connecting the cylindrical members is beneficial. Even if an attempt of forming a cylindrical member having two end surfaces with use of a metal mold instead of forming each of a plurality of portions of the cylindrical member is made, the metal mold cannot be removed from the cylindrical member after manufacture.

As described above, the switching member 103 is a cylindrical body having end surfaces in an axial direction, and is formed through connecting a plurality of members.

In a state in which the toner container 41Y is not attached to the printing unit 12, the discharge outlet 113 of the first container portion 101 is closed by a side wall of the upper portion of the side surface of the cylinder of the switching member 103, and the discharge outlet 116 of the second container portion 102 is closed by a side wall of the lower portion of the side surface of the cylinder of the switching member 103. Due to this, discharge of toner from the first container portion 101 is blocked.

As described above, when the toner container 41Y is not attached to the printing unit 12, the discharge outlet 113 and the discharge outlet 116 are closed by an outer wall surface of the switching member 103 (side surface of the cylinder of the switching member 103). During movement of the switching member 103 when the attachment of the toner container 41Y to the printing unit 12 has been started but is not completed, the discharge outlet 113 and the discharge outlet 116 are closed by the outer wall surface of the switching member 103.

Further, the discharge outlet 113 and the discharge outlet 116 are in a positional relationship such that the discharge outlet 113 and the discharge outlet 116 are closed by the outer wall surface of the switching member 103 when the switching member 103 is moved to a second position at which the aperture 114 faces a wall surface of the second chamber 102*a* of the second container portion 102.

In contrast, in FIG. 6 and FIG. 7, in a state in which the toner container 41Y is attached to the printing unit 12, through movement of the switching member 103 toward the end surface 119, the position of the aperture 114 of the switching member 103 coincides with the position of the discharge outlet 113 of the first container portion 101, and the position of the aperture 115 of the switching member 103 coincides with the position of the discharge outlet 116 of the second container portion 102.

As described above, the aperture 114 and the aperture 115 are in a positional relationship such that the aperture 115 coincides with the discharge outlet 116 when the switching member 103 is moved to a first position at which the aperture 114 coincides with the discharge outlet 113.

In FIG. 4 and FIG. 5, inside the switching member 103, an elongated conveyance member 105 that is supported by the switching member 103 and that is, for example, a screw is accommodated along the longitudinal direction of the switching member 103. A rotation transmission rod 106 whose axis is the same as the axis of the conveyance member 105 is connected to the conveyance member 105. The conveyance member 105 conveys toner contained in the switching member 103 toward the main body of the image forming device 10.

In FIG. 7, gaps between the side surface (outer wall surface) of the cylinder of the switching member 103 and an inner circumferential side surface (inner wall surface) of the cylinder of the second container portion 102 opposing the side surface of the cylinder of the switching member 103 are sealed by sealing members 161 and 162 through which neither toner nor air pass. The sealing member 161 has a shape of a cylinder that is wider than a diameter of the aperture 115 along the side surface of the cylinder of the switching member 103 around the aperture 115, and a portion of the sealing member 161 opposing the aperture 115 is cut out in accordance with the shape of the aperture 115. The sealing member 162 has a shape of a cylinder that is wider than a diameter of the aperture 114 along the side surface of the cylinder of the switching member 103 around the aperture 114, and a portion of the sealing member 162 opposing the aperture 114 is cut out in accordance with the shape of the aperture 114.

Further, in FIG. 7, an area around the supply inlet 121 of the developing unit 23 is sealed by a sealing member 165 through which neither toner nor air passes. Between an outer wall surface of the developing unit 23 and an outer wall surface of the cylinder of the second container portion 102, the sealing member 165 is located so as to cover an area around the supply inlet 121, and a portion of the sealing member 165 opposing the supply inlet 121 is cut out in accordance with the shape of the supply inlet 121.

As described above, the shell of the switching member 103 is a hollow container having a defined capacity such that the inner wall surface of the second container portion 102 is in close contact with the outer wall surface of the switching member 103 with the sealing members disposed therebetween during movement of the switching member 103. Further, the switching member 103 is movable in a reciprocating manner in the second container portion 102 along the partition wall 135 and the bottom wall 136 of the toner container 41Y.

Further, the switching member 103 opens and closes a supply path of toner extending from the first chamber 101*a* to the main body of the image forming device 10.

Further, the switching member 103 is moved after attachment of the toner container 41Y to the main body of the image forming device 10 is started until the attachment is completed, and the movement of the switching member 103 stops when the attachment is completed.

1.3 States of Toner Container 41Y

The toner container 41Y is switchable between the first state in which the toner container 41Y is not attached to the printing unit 12 and the second state in which the toner container 41Y is attached to the printing unit 12.

(First State in which Toner Container 41Y is not Attached to Printing Unit 12)

Here, "the first state in which the toner container 41Y is not attached to the printing unit 12" includes when: (i) the toner container 41Y is not attached to the printing unit 12 or (ii) the attachment of the toner container 41Y to the printing unit 12 has been started but is not completed. In the first state, the supply path 145 (FIG. 6) is closed, and discharge of toner from the first container portion 101 is blocked.

In FIG. 4 and FIG. 5, when the toner container 41Y is not attached to the printing unit 12, the switching member 103 is biased in a direction toward the end surface 118 of the second container portion 102 by the biasing member 104, the discharge outlet 113 of the first container portion 101 is closed by the side wall of the upper portion of the side surface of the cylinder of the switching member 103, and the discharge outlet 116 of the second container portion 102 is closed by the side wall of the lower portion of the side surface of the cylinder of the switching member 103. Due to this, toner in the first container portion 101 is not discharged into the chamber 107 of the switching member 103.

As described above, in the first state, the space in the second container portion 102 excluding the space occupied by the switching member 103 is blocked from the space in the first container portion 101 by the switching member 103.

(Second State in which Toner Container 41Y is Attached to Printing Unit 12)

Here, "the second state in which the toner container 41Y is attached to the printing unit 12" refers to a state in which attachment of the toner container 41Y to the printing unit 12 is completed. In the second state, the supply path 145 (FIG. 6) opens and toner is supplied to the printing unit 12. Note that the supply path 145 includes a space in the switching member 103.

When the toner container 41Y is attached to the printing unit 12, as illustrated in FIG. 6 and FIG. 7, the switching control rod 131Y, which is located on the side wall 132 and protruding to the front of the printing unit 12, is inserted from the aperture 111. Then, the switching member 103 is pressed in a direction toward the end surface 119 of the second container portion 102 (direction opposite the direction in which the toner container 41Y is attached) by the switching control rod 131Y and the switching member 103 is moved in the direction toward the end surface 119. Due to this, the aperture 114 of the switching member 103 is moved to the position of the discharge outlet 113 of the first container portion 101, the aperture 115 of the switching member 103 is moved to the position of the discharge outlet 116 of the second container portion 102, and the movement of the switching member 103 stops. The position at which the switching member 103 is stopped is defined by a length of the switching control rod 131Y.

As a result, toner in the first container portion 101 passes through the discharge outlet 113 and the aperture 114 and falls into the chamber 107.

Further, the rotation transmission rod 106 receives a rotary driving force from the printing unit 12 through the wheel mechanism 108 located at the side surface of the toner container 41Y. The transmitted rotary driving force causes the rotation transmission rod 106 to rotate, and the conveyance member 105 rotates in accordance with the rotation of the rotation transmission rod 106. Toner in the chamber 107 is conveyed from the aperture 114 in a direction toward the aperture 115 of the switching member 103 by a rotary conveyance force of the conveyance member 105.

Next, toner is supplied through the aperture 115, the discharge outlet 116, and the supply inlet 121 to the developing unit 23.

FIG. 6 and FIG. 7 illustrate the supply path 145 of toner from the toner container 41Y to the developing unit 23 of the image forming unit 21Y in a state in which the toner container 41Y is attached to the printing unit 12.

Toner held in the first container portion 101 of the toner container 41Y enters the chamber 107 of the switching member 103 through the discharge outlet 113 of the first container portion 101 and the aperture 114 of the switching member 103 along the supply path 145. Toner in the chamber 107 is conveyed from the aperture 114 in the direction toward the aperture 115 of the switching member 103 by the rotary conveyance force of the conveyance member 105. Toner that reaches the aperture 115 is supplied through the aperture 115, the discharge outlet 116 of the second container portion 102, and the supply inlet 121 of the developing unit 23 to the developing unit 23.

Summary of Embodiment

In the first state, the space in the second container portion 102 excluding the space occupied by the switching member 103 is blocked from the space in the first container portion 101 by the switching member 103. Accordingly, even when the switching member 103 is moved inside the second container portion 102, a pressure in the first container portion 101 does not change.

Further, in the first state, the outer wall of the switching member 103 closes the discharge outlet 113.

Accordingly, even when the switching member 103 is moved inside the second container portion 102, the pressure in the first container portion 101 does not change.

Accordingly, the pressure in the closed space of the first container portion 101 containing toner is no different from the external air pressure. As a result, toner in the first container portion 101 would not blow out from the discharge outlet of the toner container due to pressure difference.

Further, the aperture 111 and the aperture 112 are at the ends of the cylinder of the second container portion 102, and the hollow space inside the second container portion 102 is connected through the aperture 111 and the aperture 112 to the outside. Accordingly, in the second container portion 102, the switching member 103 can be moved freely without receiving air resistance.

Further, operations of attaching the toner container to the printing unit and detaching the toner container from the printing unit cause the switching member to move, thereby opening and closing the toner container. Thus, attachment of the toner container and opening of the toner container are performed in a single operation, and detachment of the toner container and closing of the toner container are performed in a single operation. This helps to improve operability.

Further, the position of the aperture 114 of the switching member 103 differs from the position of the discharge outlet 113 of the first container portion 101 in a state in which the toner container is not attached to the printing unit. Accordingly, toner in the first container portion 101 does not directly pressurize the discharge outlet 116 of the second container portion 102. This helps to prevent toner from scattering from the discharge outlet 116 to the outside due to the toner container vibrating during transportation.

Even if toner leaks from the discharge outlet 113 into the switching member 103 due to the toner container vibrating during transportation, the toner that leaks into the switching member 103 does not further leak from the discharge outlet 116 to the outside easily.

Further, the gaps between the side surface (outer wall surface) of the cylinder of the switching member 103 and the inner circumferential side surface (inner wall surface) of the cylinder of the second container portion 102 opposing the side surface of the cylinder of the switching member 103 are sealed by the sealing members 161 and 162 through which neither toner nor air pass. This helps to prevent toner in the toner container from leaking to the outside.

2 Modification (1)

The following describes a toner container 241Y that is a modification (1) of the above embodiment, with reference to the drawings.

Figure 8A:
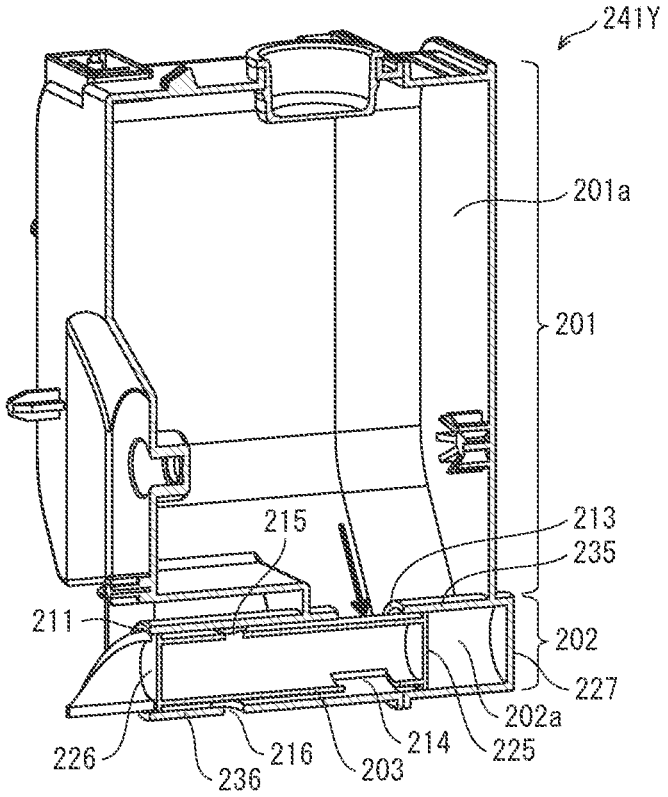
FIG. 8A is a perspective view of an inside of a toner container 241Y of a modification (1) in a state in which the toner container 241Y is not attached to the printing unit 12.
Figure 8B:
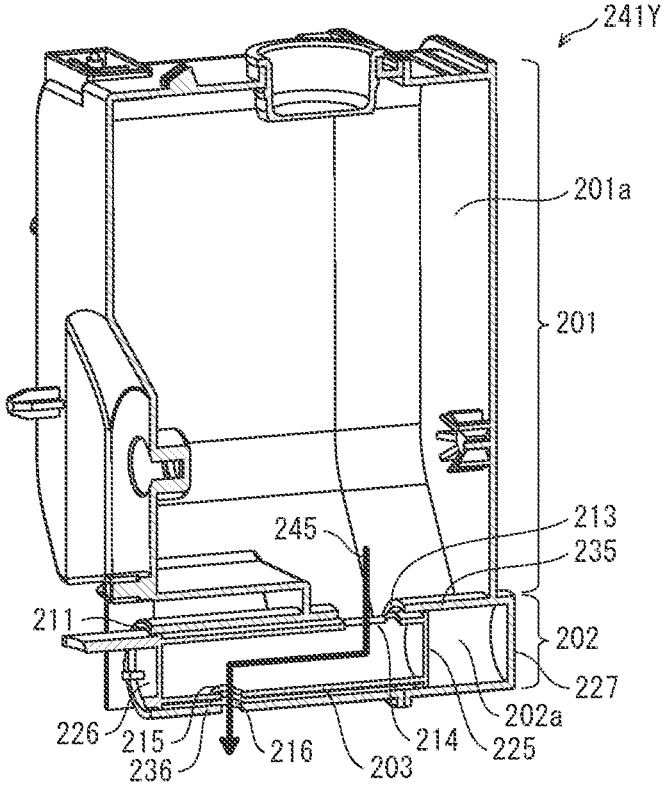
FIG. 8B is a perspective view of the inside of the toner container 241Y in a state in which the toner container 241Y is attached to a printing unit 12.

FIG. 8A is a perspective view of an inside of the toner container 241Y in a state in which the toner container 241Y is not attached to the printing unit 12. FIG. 8B is a perspective view of the inside of the toner container 241Y in a state in which the toner container 241Y is attached to the printing unit 12. Note that some components, such as a biasing member 204 described later, are not illustrated in FIG. 8A and FIG. 8B.

The toner container 241Y is attached to a container holder from the front toward the back of the housing accommodating the printing unit 12 (i.e. along the Y-axis direction). The toner container 241Y sits on the container holder. Other toner containers have structures similar to the toner container 241Y. The toner container 241Y and the other toner containers are attachable to and detachable from the main body of the image forming device 10.

The toner container 241Y has substantially the same structure as the toner container 41Y of the above embodiment. The toner container 241Y differs from the toner container 41Y mainly with respect to a switching member accommodated in a second container portion of the toner container 241Y. Here, description is provided of the switching member 203 of the toner container 241Y mainly focusing on differences from the switching member 103 of the above embodiment.

Similarly to the embodiment, in the container holders 133Y, 133M, 133C, and 133K, switching control rods 231Y, 231M, 231C, and 231K (FIG. 11A, FIG. 11B, and FIG. 11C; only the switching control rod 231Y is illustrated) are arranged on the side wall 132 (FIG. 1), which is in parallel with the X-Z plane (in a vertical direction). The switching control rods 231Y, 231M, 231C, and 231K each protrude along the main scanning direction (Y-axis direction) from inside the printing unit 12 to the front of the printing unit 12 (a direction opposite a direction along which the toner container 241Y and the other toner containers are attached). Further, at a tip of the switching control rod 231Y, a roller 232Y is disposed. The switching control rods 231M, 231C, and 231K have structures similar to the switching control rod 231Y.

As illustrated in FIG. 8A and FIG. 8B, the toner container 241Y includes a first container portion 201 and a second container portion 202 connected below the first container portion 201 (downstream along a direction along which toner is supplied). An inside of the first container portion 201 is a hollow space that is a first chamber 201*a* for storing toner. The first chamber 201*a* is adjacent to a second chamber 202*a* (described later) of the second container portion 202 at a bottom portion of the first chamber 201*a* through a partition wall 235. The partition wall 235 has a discharge outlet (first aperture) 213 and the first chamber 201*a* is connected to the second chamber 202*a* through the discharge outlet 213.

Other portions of the first container portion 201 have substantially the same structure as of the first container portion 101, and therefore are not described here.

Similarly to the second container portion 102 of the above embodiment, the second container portion 202 has a shape of a cylinder whose inside is a hollow space that is a second chamber 202*a*, and has an end surface 227 at one end of the cylinder of the second container portion 202. The second chamber 202*a* is located downstream of the first chamber 201*a* in the direction along which toner is supplied. The other end of the cylinder of the second container portion 202 does not have an end surface and is open (aperture 211; sixth aperture). A bottom wall (a bottom wall 236 of the toner container 241Y) at a lower portion of the second container portion 202 has, in a manner similar to the discharge outlet 116 of the second container portion 102, a discharge outlet (second aperture) 216. Inside the second container portion 202, the switching member 203 is accommodated (inserted) such that the switching member 203 is rotatable about an axis of the cylinder of the switching member 203.

The switching member 203 is a structure of a shell having a shape of a cylinder elongated in the same direction as a longitudinal direction of the second container portion 202, which accommodates the switching member 203, and an inside of the switching member 203 is a hollow space. The shell of the switching member 203 has end surfaces 226 and 225 of the cylinder of the switching member 203. The shell of the switching member 203 is a hollow container having a defined capacity.

In the switching member 203, an aperture (third aperture) 214 is provided at a side surface of the cylinder of the switching member 203, and an aperture (fourth aperture) 215 is provided at a side surface opposing the aperture 214 relative to the axis of the cylinder of the switching member 203.

The switching member 203 is accommodated in the second container portion 202 such that the switching member 203 is rotatable about an axis of the second container portion 202 inside the second container portion 202 in accordance with an operation of attaching the toner container 241Y to the printing unit 12.

Similarly to the above embodiment, inside the cylinder of the switching member 203, an elongated conveyance member that is, for example, a screw is accommodated along a longitudinal direction of the switching member 203. The conveyance member conveys toner contained in the switching member 203 toward the main body of the image forming device 10.

Figure 9:
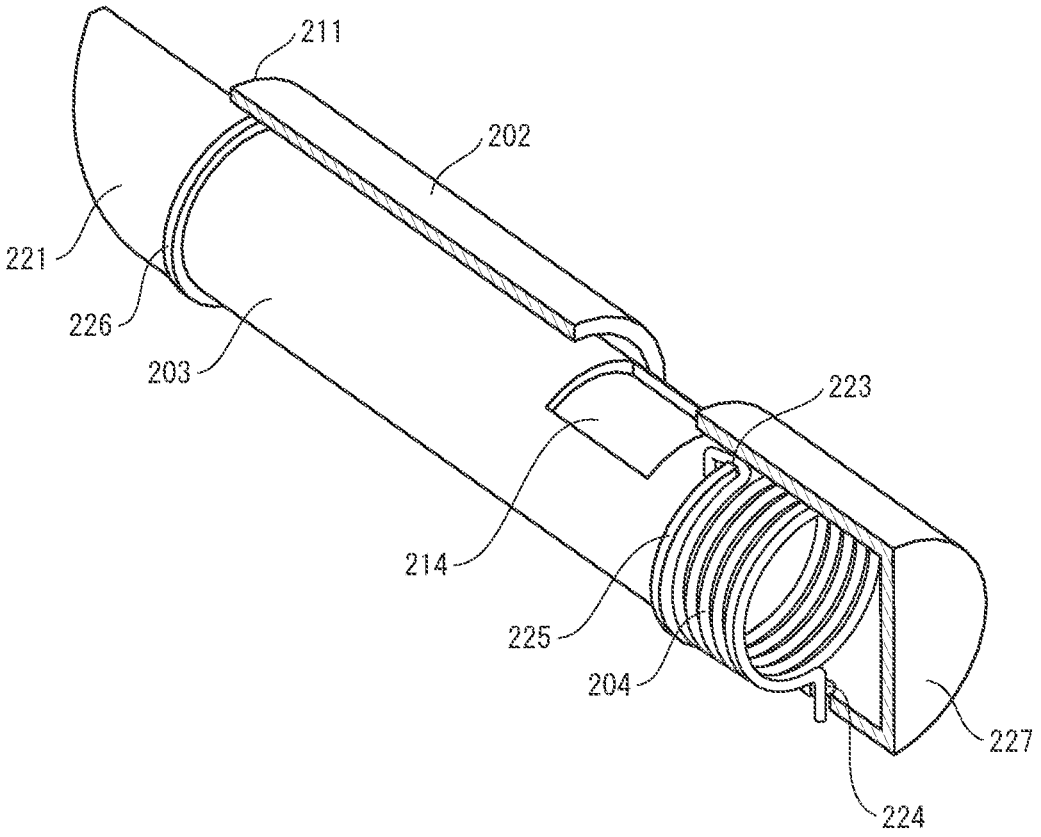
FIG. 9 is an external perspective view of a switching member 203 and a biasing member 204.

FIG. 9 is an external perspective view of the switching member 203 and the biasing member 204.

In FIG. 9, inside the second container portion 202, the biasing member 204 is provided along with the switching member 203. The biasing member 204 is, for example, a spring having a shape of a coil. One end of the coil of the biasing member 204 is engaged with an engaging recess 223 of the end surface 225 of the switching member 203, and the other end of the coil of the biasing member 204 is engaged with an engaging hole 224 provided at an end surface 227-side of the second container portion 202.

In a state in which the toner container 241Y is not attached to the printing unit 12, as illustrated in FIG. 8A, the aperture 215 is at an upper portion of the side surface of the cylinder of the switching member 203 and the aperture 214 is at a lower portion of the side surface of the cylinder of the switching member 203 inside the second container portion 202 due to a biasing rotational force about the axis of the cylinder of the second container portion 202 by the biasing member 204 (FIG. 9). Here, the position of the aperture 214 is distant from the position of the discharge outlet 213, and the discharge outlet 213 is closed by the side surface of the cylinder of the switching member 203. Further, the position of the aperture 215 is distant from the position of the discharge outlet 216, and the discharge outlet 216 is closed by the side surface of the cylinder of the switching member 203.

As described above, when the toner container 241Y is not attached to the printing unit 12, the discharge outlet 213 and the discharge outlet 216 are closed by an outer wall surface of the switching member 203 (side surface of the cylinder of the switching member 203). Further, during rotation of the switching member 203 when the attachment of the toner container 241Y to the printing unit 12 has been started but is not completed, the discharge outlet 213 and the discharge outlet 216 are closed by the outer wall surface of the switching member 203.

Further, the discharge outlet 213 and the discharge outlet 216 are in a positional relationship such that the discharge outlet 213 and the discharge outlet 216 are closed by the outer wall surface of the switching member 203 when the switching member 103 is rotated to a second position at which the aperture 214 faces a wall surface of the second chamber 202*a* of the second container portion 202.

In contrast, in a state in which the toner container 241Y is attached to the printing unit 12, as illustrated in FIG. 8B, inside the second container portion 202, the aperture 214 is at the upper portion of the side surface of the cylinder of the switching member 203 and the aperture 215 is at the lower portion of the cylinder of the switching member 203. Here, the position of the aperture 214 coincides with the position of the discharge outlet 213, and the position of the aperture 215 coincides with the position of the discharge outlet 216.

As described above, the aperture 214 and the aperture 215 are in a positional relationship such that the aperture 215 coincides with the discharge outlet 216 when the switching member 203 is rotated to a first position at which the aperture 214 coincides with the discharge outlet 213.

That is, the toner container 241Y is switched between a first state and a second state in accordance with an operation of attachment and detachment of the toner container 241Y to and from the printing unit 12. Specifically, the first state is a state in which the switching member 203 is closing the supply path to block supply of toner from the toner container 241Y when: (i) the toner container 241Y is not attached to the printing unit 12 or (ii) the attachment of the toner container 241Y to the printing unit 12 has been started but is not completed. The second state is a state in which the switching member 203 opens the supply path to supply toner to a main body of the printing unit 12 when attachment of the toner container 241Y to the printing unit 12 is completed.

Figure 10A:
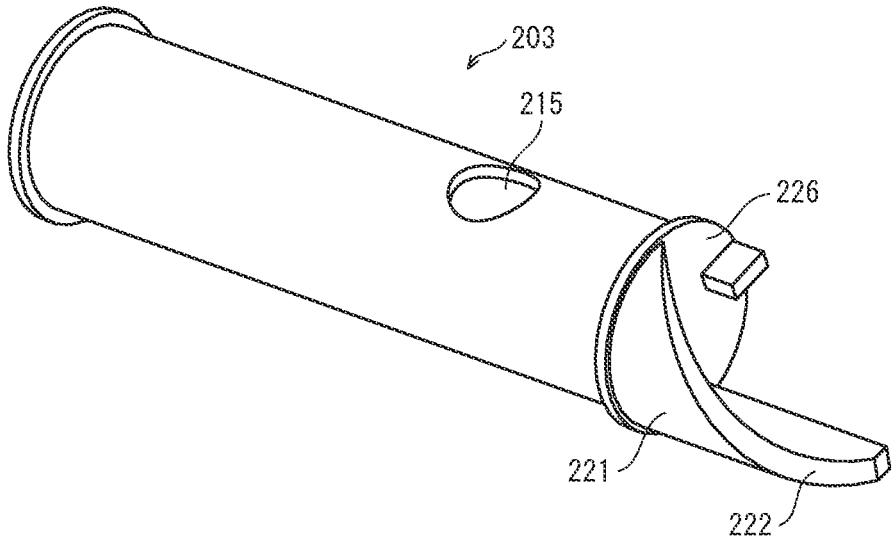
FIG. 10A is an external perspective view of the switching member 203.
Figure 10B:
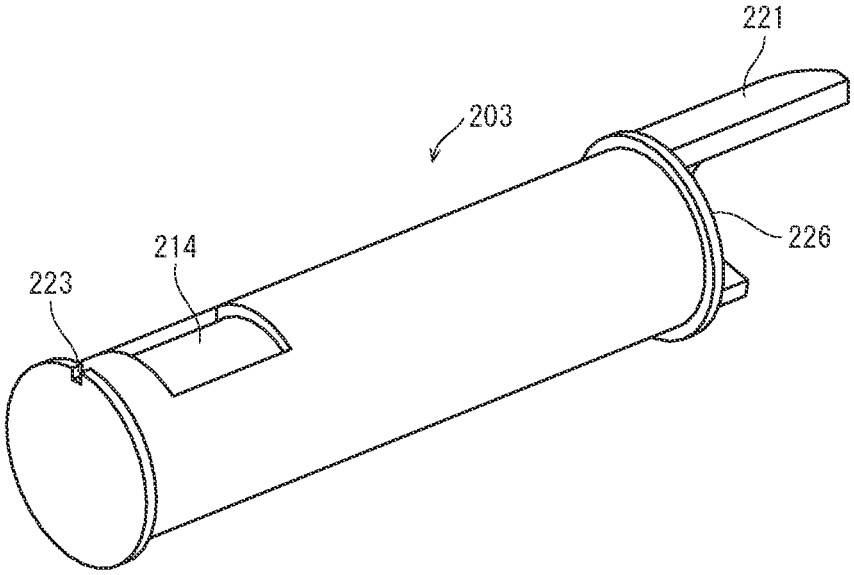
FIG. 10B is an external perspective view of the switching member 203 seen from a different direction.

FIG. 10A is an external perspective view of the switching member 203, and FIG. 10B is an external perspective view of the switching member 203 seen from a different direction.

In FIG. 9, FIG. 10A, and FIG. 10B, the end surface 226 of the switching member 203 has an end surface cam member 221. The end surface cam member 221 has a shape of a semi-cylindrical wall surface that extends from the end surface 226 to the outside in the longitudinal direction of the cylinder of the switching member 203 along the same surface as the side surface of the cylinder of the switching member 203 and is cut out such that the end surface cam member 221 has a cam surface 222 extending in a helix. The helix cam surface 222 protrudes from the aperture 211 to the outside (FIG. 8A and FIG. 8B).

Comparison of FIG. 10A and FIG. 10B reveals that the aperture 214 and the aperture 215 are on opposite sides of the cylinder of the switching member 203 across the axis of the cylinder of the switching member 203.

Figure 11A:
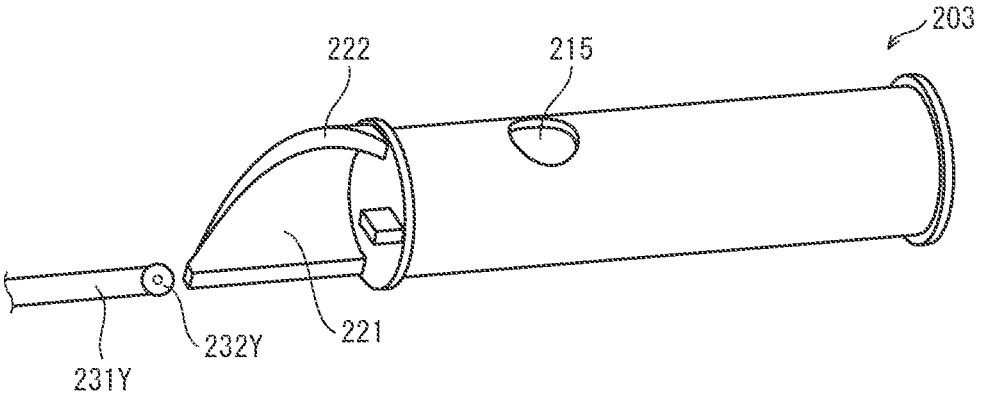
FIG. 11A, FIG. 11B, and FIG. 11C are external perspective views of rotation of the switching member 203, where
Figure 11B:
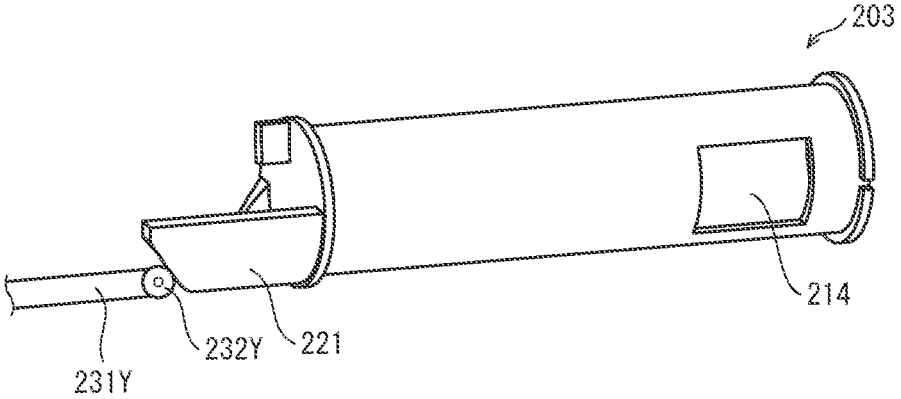
Figure 11C:
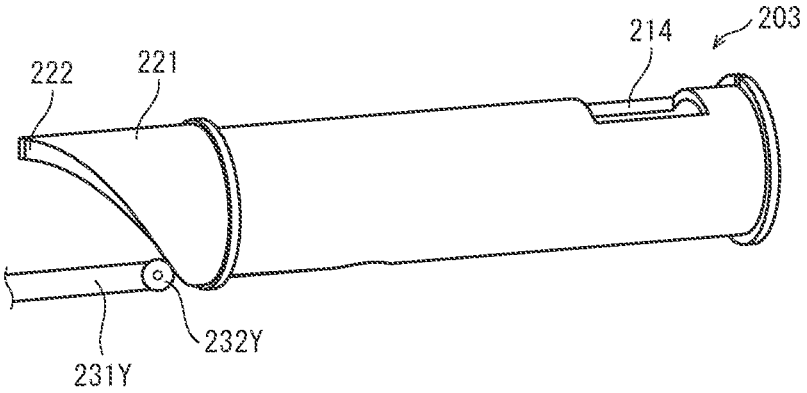

FIG. 11A is an external perspective view of the switching member 203 immediately before the switching control rod 231Y abuts the cam surface 222. FIG. 11B is an external perspective view of the switching member 203 during rotation. FIG. 11C is an external perspective view of the switching member 203 when the rotation of the switching member 203 is completed.

When attaching the toner container 241Y to the printing unit 12, firstly, the roller 232Y (cam roller) at the tip of the switching control rod 231Y approaches the cam surface 222 of the end surface cam member 221 as illustrated in FIG. 11A, and then the roller 232Y abuts the cam surface 222.

Next, when the toner container 241Y is pressed further toward the printing unit 12, the end surface cam member 221 is gradually moved toward the switching control rod 231Y as illustrated in FIG. 11B. Sliding of the roller 232Y at the tip of the switching control rod 231Y along the cam surface 222 in accordance with the movement of the end surface cam member 221 toward the switching control rod 231Y causes the end surface cam member 221 to rotate. Due to this, the switching member 203 is rotated against the biasing force of the biasing member 204.

Further, when the toner container 241Y is pressed into the back of the container holder 133Y, the rotation of the end surface cam member 221 stops as illustrated in FIG. 11C. Due to this, the rotation of the switching member 203 stops. The position at which the rotation of the switching member 203 stops is defined by a length of the switching control rod 231Y.

As described above, linear movement of the toner container 241Y relative to the switching control rod 231Y is converted into rotational movement of the switching member 203 by the end surface cam member 221.

When attachment of the toner container 241Y to the printing unit 12 is completed, the aperture 214 is rotated to the position of the discharge outlet 213 of the first container portion 201 and the aperture 215 is rotated to the position of the discharge outlet 216 of the second container portion 202 as illustrated in FIG. 8B.

That is, in accordance with the operation of attaching the toner container 241Y to the main body of the image forming device 10, the roller 232Y presses the cam surface 222 in a direction opposite the direction along which the toner container 241Y is attached and causes the switching member 203 to rotate.

Toner in the first container portion 201 of the toner container 241Y thus is supplied through the discharge outlet 213 of the first container portion 201, the apertures 214 and 215 of the switching member 203, the discharge outlet 216 of the second container portion 102, and the supply inlet 121 of the developing unit 23 to the developing unit 23 (supply path 245 in FIG. 8B).

In a state in which the toner container 241Y is not attached to the printing unit 12, the discharge outlet 213 and the discharge outlet 216 are closed by the side surface of the cylinder of the switching member 203 as illustrated in FIG. 8A. Accordingly, toner held in the first container portion 201 of the toner container 241Y is not supplied to the developing unit 23.

Further, gaps between the side surface (outer wall surface) of the cylinder of the switching member 203 and an inner circumferential side surface (inner wall surface) of the cylinder of the second container portion opposing the side surface of the cylinder of the switching member 203 are sealed by sealing members through which neither toner nor air pass. An area around the supply inlet 121 of the developing unit 23 is sealed by a sealing member through which neither toner nor air passes (not illustrated).

As described above, the shell of the switching member 203 is a hollow container having a defined capacity such that the inner wall surface of the second container portion 202 is in close contact with the outer wall surface of the switching member 203 with the sealing members disposed therebetween during rotation of the switching member 203.

Further, the switching member 203 opens and closes a supply path of toner extending from the first chamber 201*a* to the main body of the image forming device 10.

Further, the switching member 203 is rotated after attachment of the toner container 241Y to the main body of the image forming device 10 is started until the attachment is completed, and the rotation of the switching member 203 stops when the attachment is completed.

Summary of Modification (1)

As described above, in the structure of the modification (1), rotation of the switching member 203 about the axis of the cylinder of the second container portion 202 helps to prevent pressure in the toner container from changing and toner from blowing out.

Further, in the first state, the outer wall of the switching member 203 closes the discharge outlet 213. Accordingly, even when the switching member 203 is moved inside the second container portion 202, the pressure in the first container portion 201 does not change. This helps to prevent toner from blowing out.

Further, the position of the aperture 214 of the switching member 203 differs from the position of the discharge outlet 213 of the first container portion 201 in a state in which the toner container is not attached to the printing unit. Accordingly, toner in the first container portion 201 does not directly pressurize the discharge outlet 216 of the second container portion 202. This helps to prevent toner from scattering from the discharge outlet 216 to the outside due to the toner container vibrating during transportation.

Even if toner leaks from the discharge outlet 213 into the switching member 203 due to the toner container vibrating during transportation, the toner that leaks into the switching member 203 does not further leak from the discharge outlet 216 to the outside easily.

3 Modification (2)

The following describes a toner container 341Y that is a modification (2) of the above embodiment, with reference to the drawings.

Figure 12A:
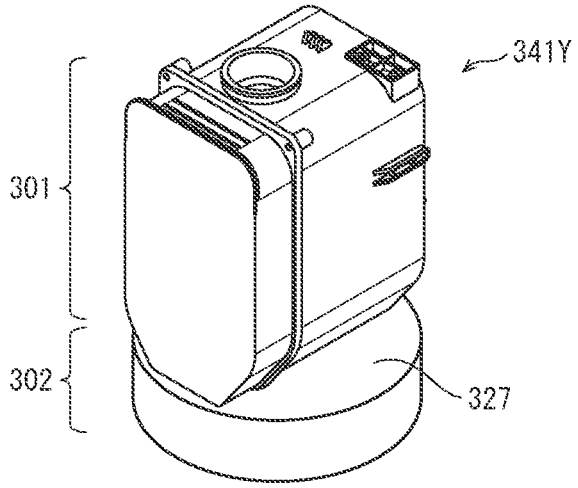
FIG. 12A is an external perspective view of a toner container 341Y of a modification (2)

FIG. 12A is an external perspective view of the toner container 341Y.

The toner container 341Y has substantially the same structure as the toner container 241Y of the above-described modification (1). The toner container 341Y differs from the toner container 241Y mainly with respect to a second container portion of the toner container. Here, description is provided of the second container portion 302 of the toner container 341Y mainly focusing on differences from the second container portion 202 of the above-described modification (1).

The toner container 341Y is attached to a container holder from an upper portion toward a lower portion of a housing accommodating the printing unit 12 (i.e. along the X-axis direction). The toner container 341Y sits on the container holder. Other toner containers have structures similar to the toner container 341Y. The toner container 341Y and the other toner containers are attachable to and detachable from the main body of the image forming device 10.

In the container holders 133Y, 133M, 133C, and 133K of the printing unit 12, switching control rods 331Y, 331M, 331C, and 331K (FIG. 13; some of which are not illustrated) are arranged on a bottom surface (not illustrated) that is in parallel with a Y-Z plane (in a horizontal direction). The switching control rods 331Y, 331M, 331C, and 331K each protrude along the X-axis direction from the bottom surface upwards (a direction opposite a direction along which the toner containers are attached). Further, at a tip of the switching control rod 331Y, a roller 332Y is disposed. The switching control rods 331M, 331C, and 331K have structures similar to the switching control rod 331Y.

As illustrated in FIG. 12A, the toner container 341Y includes a first container portion 301 and a second container portion 302 connected below the first container portion 301 (downstream along a direction along which toner is supplied). An inside of the first container portion 301 is a hollow space that is a first chamber 301*a* (FIG. 12D) for storing toner. The first chamber 301*a* is adjacent to a second chamber 302*a* (described later) of the second container portion 302 at a bottom portion of the first chamber 301*a* through a partition wall 335 (FIG. 12D). A switching member 303 is accommodated in the second container portion 302. FIG. 12F is a schematic plan view of the second container portion 302.

Figure 12B:
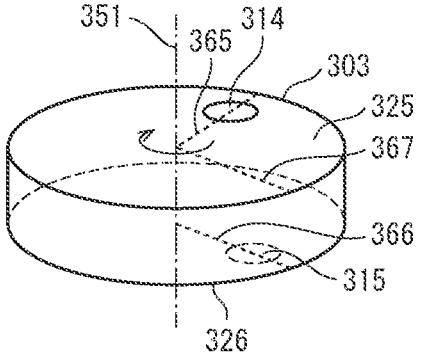
FIG. 12B is an external perspective view of a switching member 303.
Figure 12D:
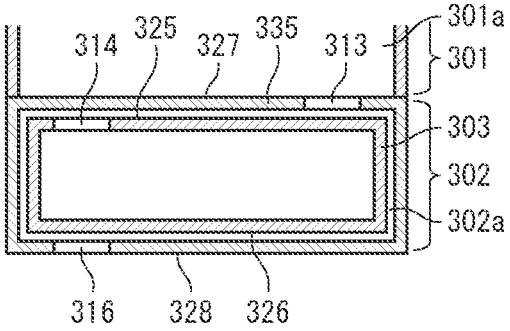
FIG. 12D is a cross-sectional view of the second container portion 302 in a state in which the toner container 341Y is not attached to the printing unit 12.
Figure 12C:
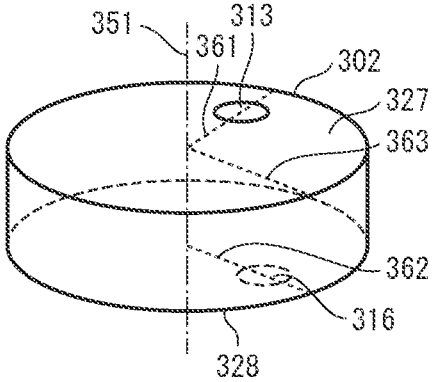
FIG. 12C is an external perspective view of a second container portion 302.
Figure 12E:
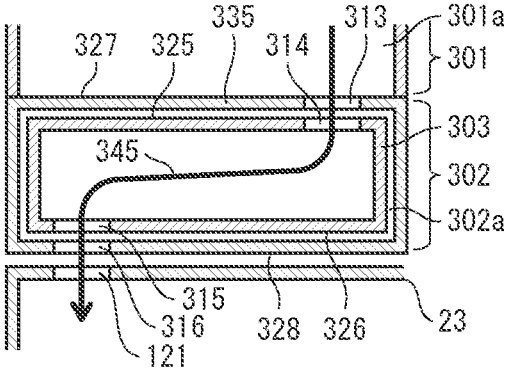
FIG. 12E is a cross-sectional view of the second container portion 302 in a state in which the toner container 341Y is attached to the printing unit 12.
Figure 12F:
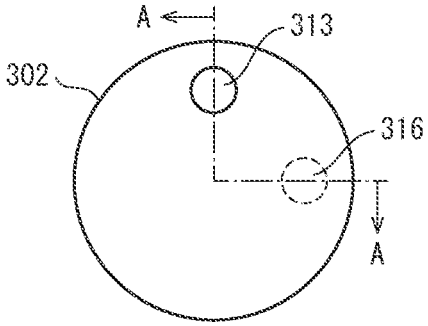
FIG. 12F is a schematic plan view of the second container portion 302.

FIG. 12B is an external perspective view of the switching member 303, and FIG. 12C is an external perspective view of the second container portion 302. FIG. 12D is a cross-sectional view of the second container portion 302 in a state in which the toner container 341Y is not attached to the printing unit 12, taken along line A-A. FIG. 12E is a cross-sectional view of the second container portion 302 in a state in which the toner container 341Y is attached to the printing unit 12, taken along line A-A.

The partition wall 335 at the bottom portion of the first container portion 301 has, in a manner similar to the discharge outlet 113 of the first container portion 101 of the above embodiment, a discharge outlet (first aperture) 313 (FIG. 12D and FIG. 12E). The first chamber 301*a* is connected through the discharge outlet 313 to the second chamber 302*a*. Other portions of the first container portion 301 have substantially the same structure as the first container portion 101, and therefore are not described here.

The second container portion 302 has a shape of a hollow cylinder having a bottom surface 327 and a bottom surface 328 (FIG. 12A, FIG. 12D, and FIG. 12E). An inside of the second container portion 302 is the second chamber 302*a*. The second chamber 302*a* is located downstream of the first chamber 301*a* in the direction along which toner is supplied. The lower bottom surface 328 (a bottom wall of the toner container 341Y) of the second container portion 302 has, in a manner similar to the discharge outlet 116 of the second container portion 102, a discharge outlet (second aperture) 316.

The discharge outlet 313 and the discharge outlet 316 are arranged such that an angle formed by a segment 361 and a segment 362 is approximately 90° when seen from an upper portion of the second container portion 302, where the segment 361 connects a center of the discharge outlet 313 and a central axis 351 of the cylinder of the second container portion 302 in the bottom surface 327 and the segment 363 is in the bottom surface 327 and in parallel with a segment 362 connecting a center of the discharge outlet 316 and the central axis 351 in the bottom surface 328 (FIG. 12C).

Inside the second container portion 302, the switching member 303 is accommodated (inserted) such that the switching member 303 is rotatable about the central axis 351 (FIG. 12B, FIG. 12D, and FIG. 12E).

The switching member 303 has a structure of a shell having a shape of a cylinder whose axis is the same as the central axis 351 of the second container portion 302. The shell of the switching member 303 includes a bottom surface 326 and a bottom surface 325 (FIG. 12B, FIG. 12D, and FIG. 12E) of the cylinder. The shell of the switching member 303 is a hollow container having a defined capacity.

The switching member 303 has an aperture (third aperture) 314 in the bottom surface 325, and has an aperture (fourth aperture) 315 in the bottom surface 326 (FIG. 12B).

The aperture 314 and the aperture 315 are arranged such that an angle formed by a segment 365 and a segment 367 is approximately 90° when seen from an upper portion of the switching member 303, where the segment 365 connects a center of the aperture 314 and the central axis 351 in the bottom surface 325 and the segment 367 is in the bottom surface 325 and in parallel with a segment 366 connecting a center of the aperture 315 and the central axis 351 in the bottom surface 326 (FIG. 12B).

Inside the cylinder of the switching member 303, a conveyance member (not illustrated) is accommodated. The conveyance member rotates about the central axis 351 and conveys toner in the proximity of the aperture 314 to the proximity of the aperture 315. The conveyance member includes, for example, four blade members that rotate about the central axis 351. Here, a rotational speed of the conveyance member differs from a rotational speed of the switching member 303. Note that the conveyance member described above may be fixed to the second container portion 302 without rotating about the central axis 351. Even when using such a structure, the switching member 303 is rotated about the central axis 351, and therefore toner is conveyed from the aperture 314 to the aperture 315.

The switching member 303 is rotated about the central axis 351 of the cylinder of the second container portion 302 inside the second container portion 302 in accordance with an operation of attaching the toner container 341Y to the printing unit 12.

Inside the second container portion 302, a biasing member (not illustrated) is provided along with the switching member 303. The biasing member is, for example, a spring having a shape of a coil. One end of the coil of the biasing member is engaged with an engaging recess provided in the bottom surface 326 of the switching member 303, and the other end of the coil of the biasing member is engaged with an engaging hole provided at an inner surface of the bottom surface 328 of the second container portion 302.

In a state in which the toner container 341Y is not attached to the printing unit 12, as illustrated in FIG. 12C and FIG. 12D, due to a biasing rotational force about the central axis 351 of the cylinder of the second container portion 302 by the biasing member, the position of the aperture 314 is distant from the position of the discharge outlet 313 and the discharge outlet 313 is closed by the bottom surface 325 of the cylinder of the switching member 303 inside the second container portion 302. Further, the position of the aperture 315 is distant from the position of the discharge outlet 316 and the discharge outlet 316 is closed by the bottom surface 326 of the cylinder of the switching member 303.

As described above, when the toner container 341Y is not attached to the printing unit 12, the discharge outlet 313 is closed by the bottom surface 325 and the discharge outlet 316 is closed by the bottom surface 326. Further, during rotation of the switching member 303 when the attachment of the toner container 341Y to the printing unit 12 has been started but is not completed, the discharge outlet 313 is closed by the bottom surface 325 and the discharge outlet 316 is closed by the bottom surface 326.

Further, the discharge outlet 313 and the discharge outlet 316 are in a positional relationship such that the discharge outlet 313 is closed by the bottom surface 325 and the discharge outlet 316 is closed by the bottom surface 326 when the switching member 303 is rotated to a second position at which the aperture 314 faces the bottom surface 327 of the second chamber 302*a* of the second container portion 302.

In contrast, in a state in which the toner container 341Y is attached to the printing unit 12, as illustrated in FIG. 12E, inside the second container portion 302, the position of the aperture 314 coincides with the position of the discharge outlet 313 and the position of the aperture 315 coincides with the position of the discharge outlet 316.

As described above, the aperture 314 and the aperture 315 are in a positional relationship such that the aperture 315 coincides with the discharge outlet 316 when the switching member 303 is rotated to a first position at which the aperture 314 coincides with the discharge outlet 313.

That is, the toner container 341Y is switched between a first state and a second state in accordance with an operation of attachment and detachment of the toner container 341Y to and from the printing unit 12. Specifically, the first state is a state in which the switching member 303 is closing the supply path to block supply of toner from the toner container 341Y when: (i) the toner container 341Y is not attached to the printing unit 12 or (ii) the attachment of the toner container 341Y to the printing unit 12 has been started but is not completed. The second state is a state in which the switching member 303 opens the supply path to supply toner to a main body of the printing unit 12 when attachment of the toner container 341Y to the printing unit 12 is completed.

Figure 13:
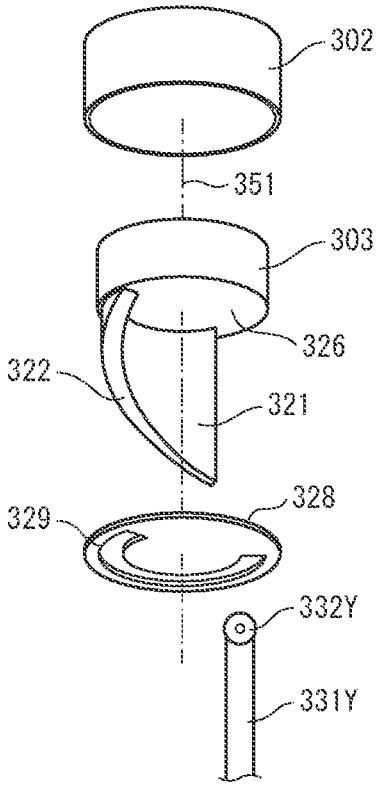
FIG. 13 is an external perspective view of the switching member 303 seen from a bottom surface-side of the switching member 303, illustrating a state in which the second container portion 302 is disassembled.
Figure 14A:
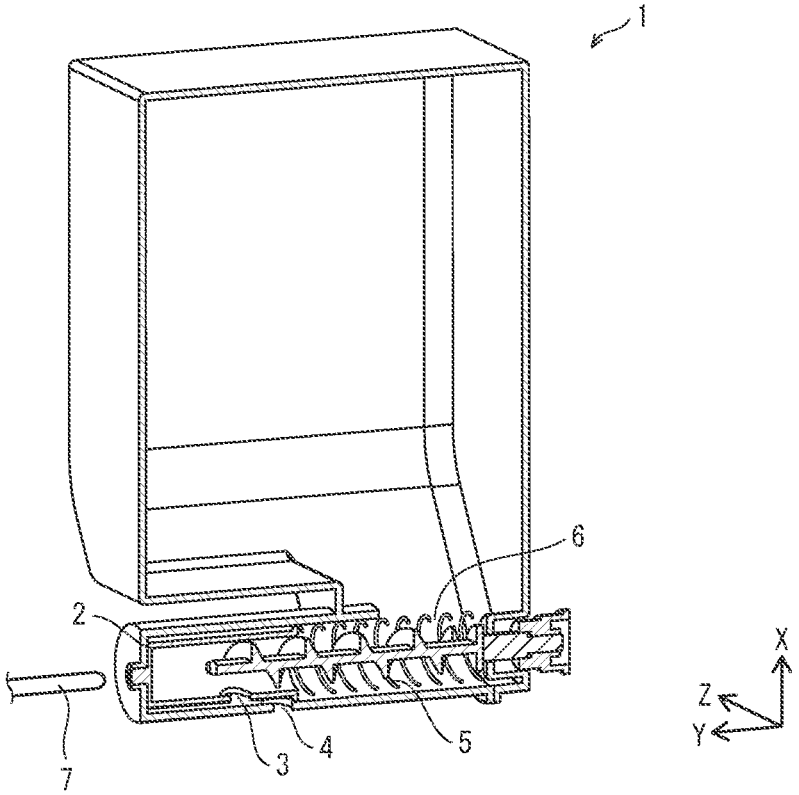
FIG. 14A is a perspective view of an inside of a conventional toner container 1.
Figure 14B:
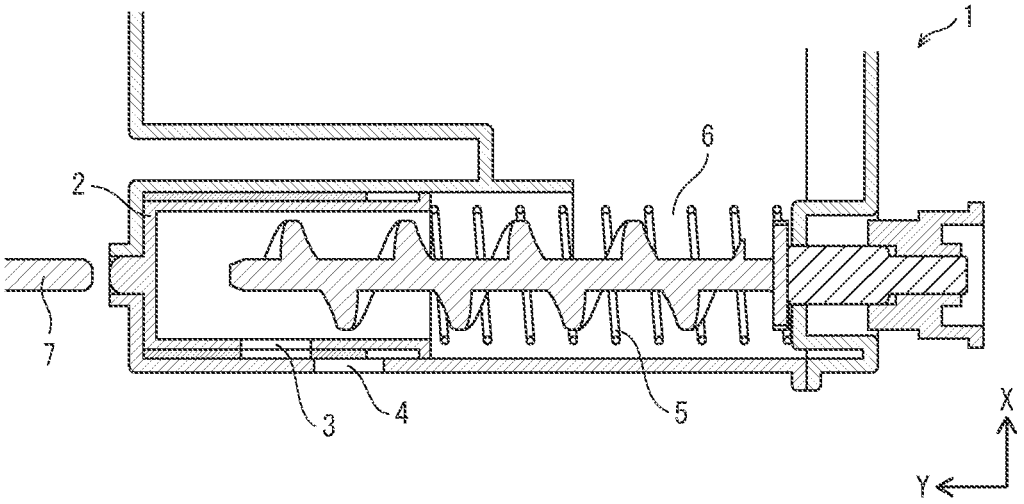
FIG. 14B is a cross-sectional view of an area around a switching member 2 of the conventional toner container 1.

FIG. 13 is an external perspective view of the switching member 303 seen from a bottom surface 326-side of the switching member 303, illustrating a state in which the second container portion 302 is disassembled.

In FIG. 13, the bottom surface 326 of the switching member 303 has an end surface cam member 321. The end surface cam member 321 has a shape of one fourth of a cylindrical wall surface that extends downwards from the bottom surface 326 in a direction along the central axis 351 of the second container portion 302 along the same surface as the side surface of the cylinder of the switching member 303 and is cut out such that the end surface cam member 321 has a cam surface 322 extending in a helix.

The bottom surface 328 of the second container portion 302 has a sectorial cutout 329 that is inside and along a circumference of the bottom surface 328 and that extends half round the circumference of the bottom surface 328. The end surface cam member 321 protrudes from the cutout 329 to the outside.

Similarly to the modification (1), when attaching the toner container 341Y to the printing unit 12, the roller 332Y at the tip of the switching control rod 331Y approaches the cam surface 322 of the end surface cam member 321. Next, the roller 332Y abuts the cam surface 322. When the toner container 341Y is pressed further towards the lower portion of the printing unit 12, the end surface cam member 321 is gradually moved towards the switching control rod 331Y. Sliding of the roller 332Y at the tip of the switching control rod 331Y along the cam surface 322 in accordance with the movement of the end surface cam member 321 toward the switching control rod 331Y causes the end surface cam member 321 to rotate. Due to this, the switching member 303 is rotated. Further, when the toner container 341Y is pressed into a bottom of the container holder 133Y, the rotation of the end surface cam member 321 stops. Due to this, the rotation of the switching member 303 stops. The position at which the rotation of the switching member 303 stops is defined by a length of the switching control rod 331Y.

As described above, linear movement of the switching control rod 331Y is converted into rotational movement of the switching member 303 by the end surface cam member 321.

When attachment of the toner container 341Y to the printing unit 12 is completed, as illustrated in FIG. 12E, the aperture 314 is moved in rotation to the position of the discharge outlet 313 of the first container portion 301 and the aperture 315 is moved in rotation to the position of the discharge outlet 316 of the second container portion 302.

Toner in the first container portion 301 of the toner container 341Y thus is supplied through the discharge outlet 313 of the first container portion 301, the apertures 314 and 315 of the switching member 303, the discharge outlet 316 of the second container portion 302, and the supply inlet 121 of the developing unit 23 to the developing unit 23 (supply path 345 in FIG. 12E).

In a state in which the toner container 341Y is not attached to the printing unit 12, as illustrated in FIG. 12D, the discharge outlet 313 is closed by the bottom surface 325 of the switching member 303 and the discharge outlet 316 is closed by the bottom surface 326 of the switching member 303. Accordingly, toner held in the first container portion 301 of the toner container 341Y is not supplied to the developing unit 23.

Further, a gap between the bottom surface 325 of the switching member 303 and the bottom surface 327 of the second container portion 302 facing the bottom surface 325 of the switching member 303 is sealed by a sealing member through which neither toner nor air passes. Likewise, a gap between the bottom surface 326 of the switching member 303 and the bottom surface 328 of the second container portion 302 facing the bottom surface 326 of the switching member 303 is sealed by a sealing member through which neither toner nor air passes. An area around the supply inlet 121 of the developing unit 23 is sealed by a sealing member through which neither toner nor air passes (not illustrated).

As described above, the shell of the switching member 303 is a hollow container having a defined capacity such that the bottom surface 325 of the second container portion 303 is in close contact with the bottom surface 327 of the second container portion 302 with the sealing member disposed therebetween and the bottom surface 326 of the second container portion 303 is in close contact with the bottom surface 328 of the second container portion 302 with the sealing member disposed therebetween during rotation of the switching member 303.

Further, the switching member 303 opens and closes a supply path of toner extending from the first chamber 301*a* to the main body of the image forming device 10.

Further, the switching member 303 is rotated after attachment of the toner container 341Y to the main body of the image forming device 10 is started until the attachment is completed, and the rotation of the switching member 303 stops when the attachment is completed.

Summary of Modification (2)

As described above, in the structure of the modification (2), rotation of the switching member 303 about the axis of the cylinder of the second container portion 302 helps to prevent pressure in the toner container from changing and toner from blowing out.

Further, in the first state, the bottom surface 325 of the switching member 303 closes the discharge outlet 313. Accordingly, even when the switching member 303 is moved inside the second container portion 302, the pressure in the first container portion 301 does not change. This helps to prevent toner from blowing out.

Further, the position of the aperture 314 of the switching member 303 differs from the position of the discharge outlet 313 of the first container portion 301 in a state in which the toner container is not attached to the printing unit. Accordingly, toner in the first container portion 301 does not directly pressurize the discharge outlet 316 of the second container portion 302. This helps to prevent toner from scattering from the discharge outlet 316 to the outside due to the toner container vibrating during transportation.

Even if toner leaks from the discharge outlet 313 into the switching member 303 due to the toner container vibrating during transportation, the toner that leaks into the switching member 303 does not further leak from the discharge outlet 316 to the outside easily.

4 Other Modifications

Although the present disclosure has been described based on the above embodiment and modifications, the present disclosure should not be construed as being limited to the above embodiment and modifications. The following cases are also included in the present disclosure.

(1) In the above embodiment, the end surface 118 of the second container portion 102 has the aperture 111, and the end surface 119 of the second container portion 102 has the aperture 112. Here, the aperture 111 functions both as the insertion hole through which the switching control rod 131Y is inserted and the vent hole for ventilating to the outside, and therefore it is beneficial that the aperture 111 be located at the position in the above embodiment.

However, the position of the aperture 112 should not be construed as being limited to the position in the above embodiment. A structure in which an aperture is located at a side surface of the cylinder of the second container portion 102 in the proximity of the end surface 119 is possible.

Further, in addition to the aperture 111, a vent hole for ventilating to the outside may be located in the proximity of the aperture 111.

(2) In the above embodiment and modifications, the discharge outlet of the second container portion is connected to the supply inlet 121 of the developing device 23. However, the present disclosure should not be construed as being limited to this.

A hopper that is a conveyance member conveying toner may be located between the discharge outlet of the second container portion and the supply inlet 121 of the developing device 23. Toner may be supplied from the discharge outlet of the second container portion through the hopper to the supply inlet 121 of the developing unit 23.

(3) In the above embodiment, the switching member 103 is a cylindrical body having end surfaces (bottom walls) in the axial direction, and is formed through connecting the cylindrical body 103*a* and the cylindrical body 103*b* such that the direction of the axis of the cylindrical member 103*a* is the same as the direction of the axis of the cylindrical member 103*b*. The cylindrical member 103*a* only has the end surface 152, and the cylindrical member 103*b* only has the end surface 151. However, the present disclosure should not be construed as being limited to this.

The switching member may be formed through connecting (i) a cylindrical body having one end in which an end surface is located and the other end that is open and (ii) a circular plate for closing the open end of the cylindrical body.

Alternatively, the switching member may be formed through connecting a first circular plate that is to be one end surface, a cylindrical body whose ends are open and do not have end surfaces, and a second circular plate that is to be the other end surface.

Alternatively, the switching member may be formed through connecting a first cylindrical body having one end in which an end surface is located and the other end that is open, a second cylindrical body whose ends are open and do not have end surfaces, and a third cylindrical body having one end in which the other end surface opposing the end surface of the first cylindrical body is located and the other end that is open, such that the directions of the axes of the first cylindrical body, the second cylindrical body, and the third cylindrical body are the same.

Alternatively, the switching member may be formed through connecting two members each having one semi-cylindrical wall surface and semi-circular end surfaces at both ends of the semi-cylindrical wall surface. Here, "two members each having one semi-cylindrical wall surface and semi-circular end surfaces at both ends of the semi-cylindrical wall surface" have shapes as if a hollow cylindrical body having circular end surfaces at both ends is cut along a plane including the entirety of the axis of the cylindrical body.

Forming the cylindrical body through connecting a plurality of members as described above is beneficial when forming the members by using metal molds.

Further, the switching member of the modification (1) and the modification (2) may have the above-described component structure.

As described above, the switching member may be a cylindrical body having end surfaces at ends in the axial direction, and may be formed through connecting a plurality of members.

Note that the switching member need not necessarily be made of a plurality of members as described above when the switching member is produced by using a 3D printer.

(4) The image forming device may be a tandem-type color printer device including a printing unit forming a toner image on a recording sheet and a sheet feeding unit storing and supplying a recording sheet, or may be a monochrome printer device.

(5) The above embodiment and the above modifications may be combined.

[Review]

A toner container reflecting at least one aspect of the present disclosure is a toner container that is attachable to and detachable from a main body of an image forming device, the toner container including: a first chamber that contains toner; a second chamber that is adjacent to the first chamber through a partition wall and that is located downstream of the first chamber in a direction along which toner is supplied; and a switching member that is accommodated in the second chamber, that is movable or rotatable in the second chamber, and that has a structure of a shell. In the toner container, the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member. Here, the inner wall surface of the second chamber may be an inner wall surface of the bottom wall of the second chamber.

In the toner container, when the switching member reaches the second position, the second aperture may be at a position such that the second aperture is closed by the shell of the switching member.

In the toner container, the switching member may be switched between a first state and a second state in accordance with attachment and detachment of the toner container to and from the main body, where the first state is a state in which the switching member is located at the second position where the switching member blocks supply of toner from the toner container to the main body when (i) the toner container is not attached to the main body or (ii) the attachment of the toner container to the main body has been started but is not completed, and the second state is a state in which the switching member is located at the first position where the switching member allows supply of toner to the main body when the attachment is completed.

The toner container may further include a biasing member that is accommodated in the second chamber and that biases the switching member towards the first state.

In the toner container, the switching member may be moved or rotated with the first aperture closed by the shell after attachment of the toner container to the main body is started until the attachment is completed; and the movement or rotation of the switching member may be stopped with the third aperture coinciding with the first aperture and the fourth aperture coinciding with the second aperture when the attachment is completed.

In the toner container, the shell of the switching member may be a container having a defined capacity.

In the toner container, the inner wall surface of the second chamber and the shell of the switching member may be in close contact with a sealing member disposed therebetween.

In the toner container, the sealing member may include a material through which neither toner nor air passes.

In the toner container, the switching member may be a cylindrical body having end surfaces at ends in an axial direction of the cylindrical body and be formed through connecting a plurality of members.

The toner container may further include a conveyance member that is supported by the switching member inside the switching member and conveys toner contained inside the switching member toward the main body.

In the toner container, the switching member may be movable in a reciprocating manner in the second chamber along the partition wall and a bottom wall of the toner container, and the second chamber may have vent holes that ventilate to the outside at ends in a direction along which the switching member is moved.

In the toner container, the switching member may be movable in a reciprocating manner in the second chamber along the partition wall and a bottom wall of the toner container, a side wall of the second chamber at one end of the second chamber in a direction along which the switching member is movable may have a fifth aperture, the main body may have a rod that protrudes in a direction opposite a direction along which the toner container is attached to the main body, and the rod may pass through the fifth aperture to the second chamber and press the switching member in the direction opposite the direction along which the toner container is attached in accordance with the attachment of the toner container, thereby moving the switching member.

In the toner container, the second chamber may be a cylindrical body whose axial direction is in parallel with a bottom wall of the toner container and have a sixth aperture at one end of the second chamber, the switching member may be a cylindrical body, be rotatable in the second chamber, and have a helix-shaped cam surface that protrudes from the sixth aperture of the second chamber, the main body may have a rod that protrudes in a direction opposite a direction along which the toner container is attached, the rod having a cam roller at a tip of the rod, and the cam roller may press the cam surface in the direction opposite the direction along which the toner container is attached in accordance with the attachment of the toner container to the main body, thereby rotating the switching member.

An image forming device reflecting at least one aspect of the present disclosure is an image forming device having a main body to which a toner container is attached, the toner container including: a first chamber that contains toner; a second chamber that is adjacent to the first chamber through a partition wall and that is located downstream of the first chamber in a direction along which toner is supplied; and a switching member that is accommodated in the second chamber, that is movable or rotatable in the second chamber, and that has a structure of a shell. In the toner container, the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member. Here, the inner wall surface of the second chamber may be an inner wall surface of the bottom wall of the second chamber.

The toner container pertaining to the present disclosure helps to eliminate the difference between the pressure inside the closed space in the toner container and the external air pressure and to prevent toner held inside the toner container from blowing out from the discharge outlet of the toner container, and is beneficial as a toner container that is attachable to and detachable from a main body of an image forming device and that supplies toner.

Although one or more embodiments of the present disclosure have been described and illustrated in detail, the disclosed embodiments are made for the purposes of illustration and example only and not limitation. The scope of the present disclosure should be interpreted by the terms of the appended claims.

What is claimed is:

1. A toner container that is attachable to and detachable from a main body of an image forming device, the toner container comprising:

a first chamber that contains toner;

a second chamber that is adjacent to the first chamber through a partition wall and that is located downstream of the first chamber in a direction along which toner is supplied; and a switching member that is accommodated in the second chamber, that is movable in the second chamber in a longitudinal direction of the switching member, and that has a structure of a shell, wherein the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member.

2. The toner container of claim 1, wherein when the switching member reaches the second position, the second aperture is at a position such that the second aperture is closed by the shell of the switching member.

3. The toner container of claim 2, wherein the switching member is switched between a first state and a second state in accordance with attachment and detachment of the toner container to and from the main body, where the first state is a state in which the switching member is located at the second position where the switching member blocks supply of toner from the toner container to the main body when (i) the toner container is not attached to the main body or (ii) the attachment of the toner container to the main body has been started but is not completed, and the second state is a state in which the switching member is located at the first position where the switching member allows supply of toner to the main body when the attachment is completed.

4. The toner container of claim 3 further comprising a biasing member that is accommodated in the second chamber and that biases the switching member towards the first state.

5. The toner container of claim 1, wherein the shell of the switching member is a container having a defined capacity.

6. The toner container of claim 1, wherein the inner wall surface of the second chamber and the shell of the switching member are in close contact with a sealing member disposed therebetween.

7. The toner container of claim 6, wherein the sealing member includes a material through which neither toner nor air passes.

8. The toner container of claim 1, wherein the switching member is a cylindrical body having end surfaces at ends in an axial direction of the cylindrical body and is formed through connecting a plurality of members.

9. The toner container of claim 1 further comprising a conveyance member that is supported by the switching member inside the switching member and conveys toner contained inside the switching member toward the main body.

10. The toner container of claim 1, wherein the switching member is movable in a reciprocating manner in the second chamber along the partition wall and a bottom wall of the toner container, and the second chamber has vent holes that ventilate to the outside at ends in a direction along which the switching member is moved.

11. The toner container of claim 1, wherein the second chamber is elongated in a longitudinal direction of the second chamber and the longitudinal direction of the switching member is the same as the longitudinal direction of the second chamber.

12. The toner container of claim 11, wherein the second chamber exhibits a cylindrical shape, the longitudinal direction of the second chamber is an axial direction of the cylindrical shape, and the switching member is a cylindrical body elongated in the same direction as the longitudinal direction of the second chamber.

13. A toner container that is attachable to and detachable from a main body of an image forming device, the toner container comprising:

a first chamber that contains toner;

a second chamber that is adjacent to the first chamber through a partition wall and that is located downstream of the first chamber in a direction along which toner is supplied; and a switching member that is accommodated in the second chamber, that is movable or rotatable in the second chamber, and that has a structure of a shell, wherein the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member;

the switching member is moved or rotated with the first aperture closed by the shell after attachment of the toner container to the main body is started until the attachment is completed; and the movement or rotation of the switching member is stopped with the third aperture coinciding with the first aperture and the fourth aperture coinciding with the second aperture when the attachment is completed.

14. A toner container that is attachable to and detachable from a main body of an image forming device, the toner container comprising:

a first chamber that contains toner;

a second chamber that is adjacent to the first chamber through a partition wall and that is located downstream of the first chamber in a direction along which toner is supplied; and a switching member that is accommodated in the second chamber, that is movable or rotatable in the second chamber, and that has a structure of a shell, wherein the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member;

the switching member is movable in a reciprocating manner in the second chamber along the partition wall and a bottom wall of the toner container, a side wall of the second chamber at one end of the second chamber in a direction along which the switching member is movable has a fifth aperture, the main body has a rod that protrudes in a direction opposite a direction along which the toner container is attached to the main body, and the rod passes through the fifth aperture to the second chamber and presses the switching member in the direction opposite the direction along which the toner container is attached in accordance with the attachment of the toner container, thereby moving the switching member.

15. A toner container that is attachable to and detachable from a main body of an image forming device, the toner container comprising:

a first chamber that contains toner;

a second chamber that is adjacent to the first chamber through a partition wall and that is located downstream of the first chamber in a direction along which toner is supplied; and a switching member that is accommodated in the second chamber, that is movable or rotatable in the second chamber, and that has a structure of a shell, wherein the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member;

the second chamber is a cylindrical body whose axial direction is in parallel with a bottom wall of the toner container and has a sixth aperture at one end of the second chamber, the switching member is a cylindrical body, is rotatable in the second chamber, and has a helix-shaped cam surface that protrudes from the sixth aperture of the second chamber, the main body has a rod that protrudes in a direction opposite a direction along which the toner container is attached, the rod having a cam roller at a tip of the rod, and the cam roller presses the cam surface in the direction opposite the direction along which the toner container is attached in accordance with the attachment of the toner container to the main body, thereby rotating the switching member.

16. An image forming device having a main body to which a toner container is attached, the toner container comprising:

a first chamber that contains toner;

a second chamber that is adjacent to the first chamber through a partition wall and that is located downstream of the first chamber in a direction along which toner is supplied; and a switching member that is accommodated in the second chamber, that is movable in the second chamber in a longitudinal direction of the switching member, and that has a structure of a shell, wherein the partition wall has a first aperture, a bottom wall of the second chamber that opposes the partition wall has a second aperture, and sits on the main body when the toner container is attached to the main body, the shell of the switching member has a third aperture and a fourth aperture, the third aperture and the fourth aperture are in a positional relationship such that the fourth aperture coincides with the second aperture when the switching member reaches a first position at which the third aperture coincides with the first aperture through movement or rotation of the switching member, and the first aperture is closed by the shell of the switching member when the switching member reaches a second position at which the third aperture faces an inner wall surface of the second chamber through movement or rotation of the switching member.

* * * * *